US011168271B2

(12) United States Patent
Oprins et al.

(10) Patent No.: US 11,168,271 B2
(45) Date of Patent: Nov. 9, 2021

(54) INTEGRATED HYDROTREATING AND STEAM PYROLYSIS PROCESS FOR THE DIRECT PROCESSING OF A CRUDE OIL TO PRODUCE OLEFINIC AND AROMATIC PETROCHEMICALS

(71) Applicant: SABIC GLOBAL TECHNOLOGIES B.V., Bergen Op Zoom (NL)

(72) Inventors: Arno Johannes Maria Oprins, Geleen (NL); Andrew Mark Ward, Geleen (NL); Raul Velasco Pelaez, Geleen (NL); Egidius Jacoba Maria Schaerlaeckens, Geleen (NL); Joris Van Willigenburg, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 123 days.

(21) Appl. No.: 16/480,469

(22) PCT Filed: Feb. 2, 2018

(86) PCT No.: PCT/IB2018/050673
§ 371 (c)(1),
(2) Date: Jul. 24, 2019

(87) PCT Pub. No.: WO2018/142343
PCT Pub. Date: Aug. 9, 2018

(65) Prior Publication Data

US 2019/0352569 A1 Nov. 21, 2019

(30) Foreign Application Priority Data

Feb. 2, 2017 (EP) ..... 17154390
Feb. 2, 2017 (EP) ..... 17154392
(Continued)

(51) Int. Cl.
*C10G 69/06* (2006.01)
*C10G 9/36* (2006.01)
(Continued)

(52) U.S. Cl.
CPC ..... *C10G 69/06* (2013.01); *C10G 9/36* (2013.01); *C10G 45/00* (2013.01); *C10G 47/26* (2013.01);
(Continued)

(58) Field of Classification Search
None
See application file for complete search history.

(56) References Cited

U.S. PATENT DOCUMENTS 6,153,087 A 11/2000 Bigeard et al.
6,270,654 B1 8/2001 Colyar et al.
(Continued)

FOREIGN PATENT DOCUMENTS

CN 104093821 10/2014
CN 104245890 12/2014
(Continued)

OTHER PUBLICATIONS

International Search Report and Written Opinion issued in International Patent Application No. PCT/IB2018/050673, dated Apr. 24, 2018.
(Continued)

*Primary Examiner* — Derek N Mueller
(74) *Attorney, Agent, or Firm* — Norton Rose Fulbright US LLP

(57) ABSTRACT

An integrated hydrotreating and steam pyrolysis process for the direct processing of a crude oil to produce olefinic and aromatic petrochemicals by separating the crude oil into light components and heavy components.

14 Claims, 4 Drawing Sheets

(30) Foreign Application Priority Data

Feb. 2, 2017 (EP) ..... 17154393
Feb. 2, 2017 (EP) ..... 17154397

(51) Int. Cl.

*C10G 45/00* (2006.01)
*C10G 47/26* (2006.01)
*C10G 49/00* (2006.01)
*C10G 49/12* (2006.01)
*C10G 67/10* (2006.01)

(52) U.S. Cl.

CPC ..... *C10G 49/007* (2013.01); *C10G 49/12* (2013.01); *C10G 67/10* (2013.01); *C10G 2300/301* (2013.01); *C10G 2400/20* (2013.01); *C10G 2400/22* (2013.01); *C10G 2400/30* (2013.01)

(56) References Cited

U.S. PATENT DOCUMENTS

| | | | | |
|---|---|---|---|---|
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,279,088 | B2 | 3/2016 | Shafi et al. | |
| 9,840,674 | B2 | 12/2017 | Weiss et al. | |
| 2007/0090018 | A1 | 4/2007 | Keusenkothen et al. | |
| 2008/0093262 | A1 | 4/2008 | Gragnani et al. | |
| 2011/0042269 | A1* | 2/2011 | Kuechler | C10G 45/00 208/57 |
| 2013/0197284 | A1 | 8/2013 | Bourane et al. | |
| 2013/0220884 | A1 | 8/2013 | Bourane et al. | |
| 2013/0228495 | A1† | 9/2013 | Shafi | |
| 2013/0228496 | A1 | 9/2013 | Bourane et al. | |
| 2013/0233766 | A1† | 9/2013 | Shafi | |
| 2013/0248417 | A1† | 9/2013 | Sayed | |
| 2013/0248418 | A1† | 9/2013 | Sayed | |
| 2014/0299515 | A1 | 10/2014 | Weiss et al. | |
| 2016/0122666 | A1 | 5/2016 | Weiss et al. | |

FOREIGN PATENT DOCUMENTS

| | | |
|---|---|---|
| CN | 104254590 | 12/2014 |
| WO | WO 2013/033293 | 3/2013 |
| WO | WO 2013/112967 | 8/2013 |
| WO | WO 2013/112969 | 8/2013 |
| WO | WO 2015/128046 | 9/2015 |
| WO | WO 2016/146326 | 9/2016 |

OTHER PUBLICATIONS

Office Action issued in Corresponding Chinese Application No. 201880020904.7, dated Apr. 7, 2021 (English Translation provided).

* cited by examiner
† cited by third party

INTEGRATED HYDROTREATING AND STEAM PYROLYSIS PROCESS FOR THE DIRECT PROCESSING OF A CRUDE OIL TO PRODUCE OLEFINIC AND AROMATIC PETROCHEMICALS

CROSS REFERENCE TO RELATED APPLICATIONS

This application is a national phase application under 35 U.S.C. § 371 of International Application No. PCT/IB2018/050673, filed Feb. 2, 2018 which claims the benefit of priority of European Patent Application No. 17154397.8, filed Feb. 2, 2017, European Patent Application No. 17154392.9, filed Feb. 2, 2017, European Patent Application No. 17154393.7, filed Feb. 2, 2017, and European Patent Application No. 17154390.3, filed Feb. 2, 2017, the entire contents of each of which are hereby incorporated by reference in their entireties.

FIELD OF THE INVENTION

The present invention relates to integrated hydrotreating and steam pyrolysis processes for the direct processing of a crude oil to produce olefinic and aromatic petrochemicals.

BACKGROUND OF THE INVENTION

The lower olefins (i.e., ethylene, propylene, butylene and butadiene) and aromatics (i.e., benzene, toluene and xylene) are basic intermediates which are widely used in the petrochemical and chemical industries. Thermal cracking, or steam pyrolysis, is a major type of process for forming these materials, typically in the presence of steam, and in the absence of oxygen. Feedstocks for steam pyrolysis can include petroleum gases and distillates such as naphtha, kerosene and gas oil. The availability of these feedstocks is usually limited and requires costly and energy-intensive process steps in a crude oil refinery.

WO2013033293 relates to a process for producing a hydro processed product, comprising: exposing a combined feedstock comprising a heavy oil feed component and a solvent component to a hydroprocessing catalyst to form a hydro processed effluent, separating the hydroprocessing effluent to form at least a liquid effluent and fractionating a first portion of the liquid effluent to form at least a distillate product, wherein the solvent comprises at least a portion of the distillate product, at least 90 wt. % of the at least a portion of the distillate product having a boiling point in a boiling range of 149° C. to 399° C.

WO2013112967 relates to an integrated solvent deasphalting, hydrotreating and steam pyrolysis process for direct processing of a crude oil to produce petrochemicals such as olefins and aromatics.

US2013220884 and US2013197284 relate to an integrated hydrotreating, solvent deasphalting and steam pyrolysis process for direct processing of a crude oil to produce petrochemicals such as olefins and aromatics.

US2013228496 relates to an integrated solvent deasphalting and steam pyrolysis process for direct processing of a crude oil to produce petrochemicals such as olefins and aromatics.

OBJECTS OF THE INVENTION

An object of the present invention is to provide a process for crude oil steam cracking comprising hydrotreating of crude oil fractions.

Another object of the present invention is to provide a process for crude oil steam cracking comprising hydrotreating of crude oil fractions wherein preferably only hydrocarbon fractions are subjected to hydrotreating processes that benefit from such a hydrotreating process.

Another object of the present invention is to provide an integrated hydroprocessing, steam pyrolysis and hydrocracking process for direct conversion of crude oil to produce olefinic and aromatic petrochemicals wherein a specific type of hydrocracking is used.

Another object of the present invention is to provide integrated hydroprocessing, steam pyrolysis and slurry hydroprocessing process for direct conversion of crude oil wherein highly valuable hydrocarbon streams are internally recycled to produce olefinic and aromatic petrochemicals.

Another object of the present invention is to provide integrated hydroprocessing, and steam pyrolysis process for direct conversion of crude oil wherein highly valuable hydrocarbon streams are internally recycled to produce olefinic and aromatic petrochemicals.

SUMMARY OF THE INVENTION

The present invention thus relates in part to an integrated hydrotreating and steam pyrolysis process for the direct processing of a crude oil to produce olefinic and aromatic petrochemicals, the process comprising the steps of (a1) separating the crude oil into light components and heavy components, wherein the lower boiling point of the boiling point range of said heavy components is in a range of from about 260° C. to about 350° C.; (b1) charging the heavy components and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; (c1) charging the hydroprocessed effluent and steam to a convection section of a steam pyrolysis zone; (d1) heating the mixture from step (c1) and passing it to a vapor-liquid separation section; (e1) removing from the steam pyrolysis zone a residual portion from the vapor-liquid separation section; (f1) charging light components from step (a1), a light portion from the vapor-liquid separation section, and steam to a steam pyrolysis zone for thermal cracking; (g1) recovering a mixed product stream from the steam pyrolysis zone; (h1) separating the thermally cracked mixed product stream; (i1) purifying hydrogen recovered in step (h1) and recycling it to step (b1); (j1) recovering olefins and aromatics from the separated mixed product stream; and (k1) recovering pyrolysis fuel oil from the separated mixed product stream. The integrated process according to this embodiment preferably further comprises a step (l1), comprising compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (j1) and pyrolysis fuel oil as in step (k1) from the remainder of the dehydrated compressed thermally cracked mixed product stream with a reduced content of hydrogen sulfide and carbon dioxide; and step (i1) comprises purifying recovered hydrogen from the dehydrated compressed thermally cracked mixed product stream with a reduced content of hydrogen sulfide and carbon dioxide for recycle to the hydroprocessing zone. The step of recovering hydrogen from the dehydrated compressed thermally cracked mixed product stream with a reduced content of hydrogen sulfide and carbon dioxide preferably comprises separately recovering methane for use as fuel for burners and/or heaters in the thermal cracking step. In a preferred embodiment of this system integrated hydrotreating and steam pyrolysis process for the direct processing of a crude oil to produce olefinic and aromatic petrochemicals the residual portion from the vapor-liquid separation section is blended with pyrolysis fuel oil recovered in step (k1). The step of separation of the heated hydroprocessed effluent into a vapor fraction and a liquid fraction is preferably carried out with a vapor-liquid separation device based on physical and mechanical separation. This embodiment of an integrated hydrotreating and steam pyrolysis process for the direct processing of a crude oil to produce olefinic and aromatic petrochemicals preferably comprises separating the hydroprocessing zone reactor effluents in a high pressure separator to recover a gas portion that is cleaned and recycled to the hydroprocessing zone as an additional source of hydrogen, and liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (h1).

The present invention also relates to an integrated hydroprocessing, steam pyrolysis and resid hydrocracking process for direct conversion of crude oil to produce olefinic and aromatic petrochemicals, the process comprising the steps of (a2) hydroprocessing the crude oil in the presence of hydrogen under conditions effective to produce a hydroprocessed effluent having a reduced content of contaminants, an increased paraffinicity, reduced Bureau of Mines Correlation Index, and an increased American Petroleum Institute gravity; (b2) thermally cracking hydroprocessed effluent in the presence of steam in a steam pyrolysis zone under conditions effective to produce a mixed product stream; (c2) processing heavy components derived from one or more of the hydroprocessed effluent, a heated stream within the steam pyrolysis zone, or the mixed product stream, in a resid hydrocracking zone to produce resid intermediate product, wherein said resid hydrocracking zone is selected from a group consisting of ebulated bed, moving bed and fixed bed type reactor; (d2) conveying the resid intermediate product to the step of thermally cracking; and (e2) recovering olefins and aromatics from the mixed product stream.

The present invention also relates to an integrated hydroprocessing, steam pyrolysis and slurry hydroprocessing process for direct conversion of crude oil to produce olefinic and aromatic petrochemicals, the process comprising the steps of: (a3) hydroprocessing the crude oil and a slurry process product in the presence of hydrogen under conditions effective to produce a hydroprocessed effluent having a reduced content of contaminants, an increased paraffinicity, reduced Bureau of Mines Correlation Index, and an increased American Petroleum Institute gravity; (b3) thermally cracking hydroprocessed effluent in the presence of steam in a steam pyrolysis zone under conditions effective to produce a mixed product stream; (c3) processing heavy components derived from one or more of the hydroprocessed effluent, a heated stream within the steam pyrolysis zone, or the mixed product stream, in a slurry hydroprocessing zone to produce slurry intermediate product; (d3) conveying the slurry intermediate product to the step of thermally cracking; (e3) separating a combined product stream including thermally cracked product and slurry intermediate product; (f3) purifying hydrogen recovered in step (e) and recycling it to the step of hydroprocessing; and (g3) recovering olefins and aromatics from the separated combined product stream, wherein said process further comprises separating the hydroprocessed effluent from step (a3) into a vapor phase and a liquid phase in a vapor-liquid separation zone, wherein the vapor phase is thermally cracked in step (b3), and at least a portion of the liquid phase is processed in step (a3).

The present invention thus relates to an integrated hydrotreating and steam pyrolysis process for the direct processing of crude oil to produce olefinic and aromatic petrochemicals, the process comprising the steps of (a4) charging the crude oil and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; (b4) thermally cracking hydroprocessed effluent in the presence of steam in a steam pyrolysis zone to produce a mixed product stream; (c4) separating the thermally cracked mixed product stream into hydrogen, olefins, aromatics and pyrolysis fuel oil; (d4) purifying hydrogen recovered in step (c4) and recycling it to step (a4); (e4) recovering olefins and aromatics from the separated mixed product stream; and (f4) recovering pyrolysis fuel oil from the separated mixed product stream, wherein said process further comprises separating the hydroprocessed effluent from the hydroprocessing zone into a heavy fraction and a light fraction in a hydroprocessed effluent separation zone, wherein the light fraction is the hydroprocessed effluent that is thermally cracked in step (b4), and wherein at least a part of the heavy fraction is used as a quenching medium to the inlet of a quenching zone.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%. The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

In the context of the present invention, thirty-five embodiments are now described. Embodiment 1 is an integrated hydrotreating and steam pyrolysis process for the direct processing of a crude oil to produce olefinic and aromatic petrochemicals. The process includes the steps of (a1) separating the crude oil into light components and heavy components, wherein the lower boiling point of the boiling point range of said heavy components is in a range of from about 260° C. to about 350° C.; (b1) charging the heavy components and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; (c1) charging the hydroprocessed effluent and steam to a convection section of a steam pyrolysis zone; (d1) heating the mixture from step (c1) and passing it to a vapor-liquid separation section; (e1) removing from the steam pyrolysis zone a residual portion from the vapor-liquid separation section; (f1) charging light components from step (a1), a light portion from the vapor-liquid separation section, and steam to a steam pyrolysis zone for thermal cracking; g. recovering a mixed product stream from the steam pyrolysis zone; (h1) separating the thermally cracked mixed product stream; (i1) purifying hydrogen recovered in step (l1) and recycling it to step (b1); (j1) recovering olefins and aromatics from the separated mixed product stream; and (k1) recovering pyrolysis fuel oil from the separated mixed product stream. Embodiment 2 is the integrated process of embodiment 1, wherein step (h1) includes compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (j1) and pyrolysis fuel oil as in step (k1) from the remainder of the dehydrated compressed thermally cracked mixed product stream with a reduced content of hydrogen sulfide and carbon dioxide; and step (i1) includes purifying recovered hydrogen from the dehydrated compressed thermally cracked mixed product stream with a reduced content of hydrogen sulfide and carbon dioxide for recycle to the hydroprocessing zone. Embodiment 3 is the integrated process of embodiment 2, wherein recovering hydrogen from the dehydrated compressed thermally cracked mixed product stream with a reduced content of hydrogen sulfide and carbon dioxide further includes separately recovering methane for use as fuel for burners and/or heaters in the thermal cracking step. Embodiment 4 is the integrated process of embodiment 1 wherein the residual portion from the vapor-liquid separation section is blended with pyrolysis fuel oil recovered in step (k1). Embodiment 5 is the integrated process of embodiment 1 wherein separating the heated hydroprocessed effluent into a vapor fraction and a liquid fraction is with a vapor-liquid separation device based on physical and mechanical separation. Embodiment 6 is the integrated process of embodiment 1, further including the steps of separating the hydroprocessing zone reactor effluents in a high pressure separator to recover a gas portion that is cleaned and recycled to the hydroprocessing zone as an additional source of hydrogen, and liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (h1).

Embodiment 7 is an integrated hydroprocessing, steam pyrolysis and resid hydrocracking process for direct conversion of crude oil to produce olefinic and aromatic petrochemicals. The process including the steps of (a2) hydroprocessing the crude oil in the presence of hydrogen under conditions effective to produce a hydroprocessed effluent having a reduced content of contaminants, an increased paraffinicity, reduced Bureau of Mines Correlation Index, and an increased American Petroleum Institute gravity; (b2) thermally cracking hydroprocessed effluent in the presence of steam in a steam pyrolysis zone under conditions effective to produce a mixed product stream; (c2) processing heavy components derived from one or more of the hydroprocessed effluent, a heated stream within the steam pyrolysis zone, or the mixed product stream, in a resid hydrocracking zone to produce resid intermediate product, wherein said resid hydrocracking zone is selected from a group consisting of ebulated bed, moving bed and fixed bed type reactor; (d2) conveying the resid intermediate product to the step of thermally cracking; and (e2) recovering olefins and aromatics from the mixed product stream. Embodiment 8 is the integrated process of embodiment 7, further including the step of recovering pyrolysis fuel oil from the combined mixed product stream for use as at least a portion of the heavy components cracked in step (c2). Embodiment 9 is the integrated process of embodiment 7, further including the step of separating the hydroprocessed effluent from step (a2) into a vapor phase and a liquid phase in a vapor-liquid separation zone, wherein the vapor phase is thermally cracked in step (b2), and at least a portion of the liquid phase is processed in step (c2). Embodiment 10 is the integrated process of embodiment 7, wherein step (b2) further comprises heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c2). Embodiment 11 is the integrated process of embodiment 10 wherein separating the heated hydroprocessed effluent into a vapor phase and a liquid phase is with a vapor-liquid separation device based on physical and mechanical separation. Embodiment 12 is the integrated process of embodiment 7, further including the step of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics from the remainder of the dehydrated compressed thermally cracked mixed product stream with a reduced content of hydrogen sulfide and carbon dioxide. Embodiment 13 the integrated process of embodiment 7 further including the step of purifying hydrogen from the mixed product stream and recycling it to the step of hydroprocessing. Embodiment 14 is the integrated process of embodiment 13, including the step of purifying recovered hydrogen from the dehydrated compressed thermally cracked mixed product stream with a reduced content of hydrogen sulfide and carbon dioxide for recycle to the hydroprocessing zone. Embodiment 15 is the integrated process of embodiment 13, wherein recovering hydrogen from the dehydrated compressed thermally cracked mixed product stream with a reduced content of hydrogen sulfide and carbon dioxide further comprises separately recovering methane for use as fuel for burners and/or heaters in the thermal cracking step. Embodiment 16 is the integrated process of embodiment 9, further including the step of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the thermal cracking step and the gas portion derived from the low pressure separator is combined with the combined product stream after the steam pyrolysis zone and before separation in step (e2). Embodiment 17 is the integrated process of embodiment 10, further including the step of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the vapor-liquid separation zone and the gas portion derived from the low pressure separator is combined with the combined product stream after the steam pyrolysis zone and before separation in step (e2).

Embodiment 18 is an integrated hydroprocessing, steam pyrolysis and slurry hydroprocessing process for direct conversion of crude oil to produce olefinic and aromatic petrochemicals. The process includes the steps of (a3) hydroprocessing the crude oil and a slurry process product in the presence of hydrogen under conditions effective to produce a hydroprocessed effluent having a reduced content of contaminants, an increased paraffinicity, reduced Bureau of Mines Correlation Index, and an increased American Petroleum Institute gravity; (b3) thermally cracking hydroprocessed effluent in the presence of steam in a steam pyrolysis zone under conditions effective to produce a mixed product stream; (c3) processing heavy components derived from one or more of the hydroprocessed effluent, a heated stream within the steam pyrolysis zone, or the mixed product stream, in a slurry hydroprocessing zone to produce slurry intermediate product; (d3) conveying the slurry intermediate product to the step of thermally cracking; (e3) separating a combined product stream including thermally cracked product and slurry intermediate product; (f3) purifying hydrogen recovered in step (e3) and recycling it to the step of hydroprocessing; and (g3) recovering olefins and aromatics from the separated combined product stream, wherein said process further includes the step of separating the hydroprocessed effluent from step (a3) into a vapor phase and a liquid phase in a vapor-liquid separation zone, wherein the vapor phase is thermally cracked in step (b3), and at least a portion of the liquid phase is processed in step (a3). Embodiment 19 is the integrated process of embodiment 18, further including the step of recovering pyrolysis fuel oil from the combined mixed product stream for use as at least a portion of the heavy components cracked in step (c3). Embodiment 20 is the integrated process according to any one or more of the preceding embodiments, further including the step of separating the hydroprocessed effluent from step (a3) into a vapor phase and a liquid phase in a vapor-liquid separation zone, wherein the vapor phase is thermally cracked in step (b3), and at least a portion of the liquid phase is processed in step (c3). Embodiment 21 is the integrated process according to any one or more of embodiments 18 to 20, wherein step (b3) further includes the step of heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (a3). Embodiment 22 is the integrated process according to any one or more of embodiments 18 to 21, wherein step (b3) further includes the step of heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c3). Embodiment 23 is the integrated process according to any one or more of embodiments 18 to 22, further including the step of discharging said hydroprocessed effluent from step (a3) for use as at least a portion of the heavy components processed in step (a3). Embodiment 24 is the integrated process according to any one or more of embodiments 18 to 23, wherein step (e3) includes compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics from the remainder of the dehydrated compressed thermally cracked mixed product stream with a reduced content of hydrogen sulfide and carbon dioxide; and step (f3) includes purifying recovered hydrogen from the dehydrated compressed thermally cracked mixed product stream with a reduced content of hydrogen sulfide and carbon dioxide for recycle to the hydroprocessing zone. Embodiment 25 is the integrated process according to any one or more of the preceding embodiments 18 to 24, wherein recovering hydrogen from the dehydrated compressed thermally cracked mixed product stream with a reduced content of hydrogen sulfide and carbon dioxide further includes the step of separately recovering methane for use as fuel for burners and/or heaters in the thermal cracking step. Embodiment 26 is the integrated process according to any one or more of the preceding embodiments 18 to 25, further including the step of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the thermal cracking step and the gas portion derived from the low pressure separator is combined with the combined product stream after the steam pyrolysis zone and before separation in step (e3). Embodiment 27 is the integrated process according to any one or more of the preceding embodiments 18 to 26, further including the step of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the vapor-liquid separation zone and the gas portion derived from the low pressure separator is combined with the combined product stream after the steam pyrolysis zone and before separation in step (e3).

Embodiment 28 is an integrated hydrotreating and steam pyrolysis process for the direct processing of crude oil to produce olefinic and aromatic petrochemicals. The process includes the steps of (a4) charging the crude oil and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; (b4) thermally cracking hydroprocessed effluent in the presence of steam in a steam pyrolysis zone to produce a mixed product stream; (c4) separating the thermally cracked mixed product stream into hydrogen, olefins, aromatics and pyrolysis fuel oil; (d4) purifying hydrogen recovered in step (c4) and recycling it to step (a4); (e4) recovering olefins and aromatics from the separated mixed product stream; and (f4) recovering pyrolysis fuel oil from the separated mixed product stream, wherein said process further includes the steps of separating the hydroprocessed effluent from the hydroprocessing zone into a heavy fraction and a light fraction in a hydroprocessed effluent separation zone, wherein the light fraction is the hydroprocessed effluent that is thermally cracked in step (b4), and wherein at least a part of the heavy fraction is used as a quenching medium to the inlet of a quenching zone. Embodiment 29 is the integrated process of embodiment 28, wherein at least a part of the heavy fraction is blended with pyrolysis fuel oil recovered in step (f4). Embodiment 30 is the integrated process according to any one or more of the preceding embodiments 28 to 29, wherein step (c4) includes the steps of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e4) and pyrolysis fuel oil as in step (f4) from the remainder of the dehydrated compressed thermally cracked mixed product stream with a reduced content of hydrogen sulfide and carbon dioxide; and step (d4) includes purifying recovered hydrogen from the dehydrated compressed thermally cracked mixed product stream with a reduced content of hydrogen sulfide and carbon dioxide for recycle to the hydroprocessing zone. Embodiment 31 is the integrated process according to any one or more of the preceding embodiments 28 to 29, wherein recovering hydrogen from the dehydrated compressed thermally cracked mixed product stream with a reduced content of hydrogen sulfide and carbon dioxide further includes separately recovering methane for use as fuel for burners and/or heaters in the thermal cracking step. Embodiment 32 is the integrated process according to any one or more of the preceding embodiments 28 to 31 wherein the thermal cracking step includes heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Embodiment 33 is the integrated process according to any one or more of the preceding embodiments 38 to 32 wherein the discharged liquid fraction is blended with pyrolysis fuel oil recovered in step (f4). Embodiment 34 is the integrated process according to any one or more of the preceding embodiments 28 to 33, further including the step of separating the hydroprocessing zone reactor effluents in a high pressure separator to recover a gas portion that is cleaned and recycled to the hydroprocessing zone as an additional source of hydrogen, and liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (c4). Embodiment 35 is the integrated process according to any one or more of the preceding embodiments 28 to 34, further including the step of separating the hydroprocessing zone reactor effluents in a high pressure separator to recover a gas portion that is cleaned and recycled to the hydroprocessing zone as an additional source of hydrogen, and liquid portion, separating the liquid portion from the high pressure separator in a low pressure separator into a gas portion and a liquid portion, wherein the liquid portion from the low pressure separator is the hydroprocessed effluent subjected to separation into a light fraction and a heavy fraction, and the gas portion from the low pressure separator is combined with the mixed product stream after the steam pyrolysis zone and before separation in step (c4).

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

DETAILED DESCRIPTION

Figure 1:
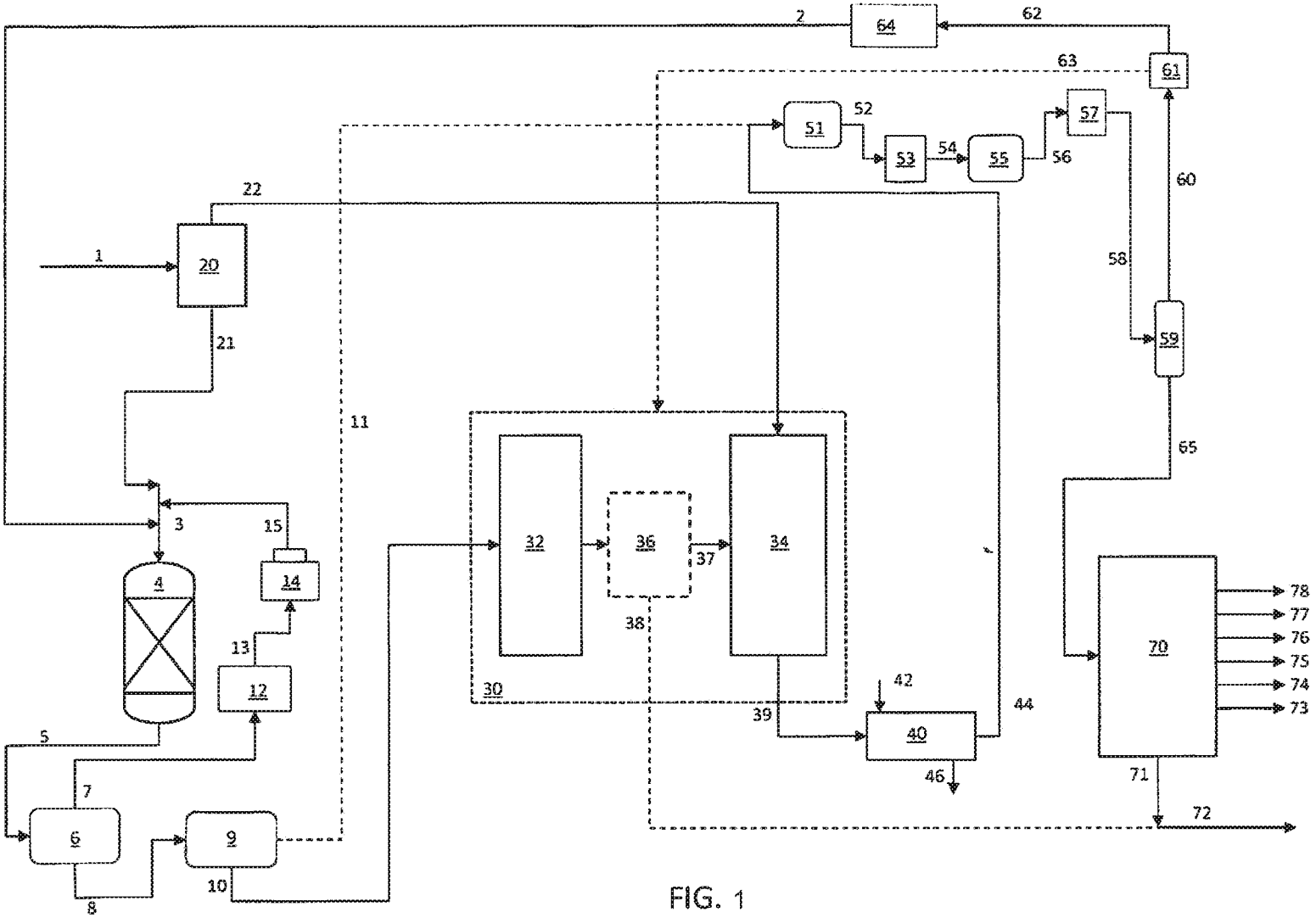
FIG. 1 is a process flow diagram of an embodiment of the present integrated process of the invention.

The invention will be described in further detail below and with reference to the attached drawings.

A process flow diagram including an integrated hydroprocessing and steam pyrolysis process and system including hydrogen redistribution according to embodiment 1 mentioned above is shown in FIG. 1. The integrated system generally includes an initial feed separation zone 20, a selective catalytic hydroprocessing zone, a steam pyrolysis zone 30 and a product separation zone.

Generally, a crude oil feed is flashed, whereby the lighter fraction (having a boiling point in a range containing minimal hydrocarbons requiring further cracking and containing readily released hydrogen, e.g., up to about 185° C.) is directly passed to the steam pyrolysis zone and only the necessary fractions, i.e. having less than a predetermined hydrogen content, is hydroprocessed. This is advantageous as it provides increased partial pressure of hydrogen in the hydroprocessing reactor, improving the efficiency of hydrogen transfer via saturation. This will decrease hydrogen solution losses and $H_2$ consumption. Readily released hydrogen contained in the crude oil feed is redistributed to maximize the yield of products such as ethylene. Redistribution of hydrogen allows for an overall reduction in heavy product and increased production of light olefins.

First separation zone 20 includes an inlet for receiving a feedstock stream 1, an outlet for discharging a light fraction 22 and an outlet for discharging a heavy fraction 21. Separation zone 20 can be a single stage separation device such a flash separator with a cut point in the range of from about 260° C. to about 350° C. The benefit of this specific cut point is that only heavy parts will be processed in hydroprocessing reaction zone 4.

In additional embodiments separation zone 20 includes, or consists essentially of (i.e., operates in the absence of a flash zone), a cyclonic phase separation device, or other separation device based on physical or mechanical separation of vapors and liquids.

The hydroprocessing zone includes a hydroprocessing reaction zone 4 includes an inlet for receiving a mixture of light hydrocarbon fraction 21 and hydrogen 2 recycled from the steam pyrolysis product stream, and make-up hydrogen as necessary. Hydroprocessing reaction zone 4 further includes an outlet for discharging a hydroprocessed effluent 5.

Reactor effluents 5 from the hydroprocessing reactor(s) are cooled in a heat exchanger (not shown) and sent to a high pressure separator 6. The separator tops 7 are cleaned in an amine unit 12 and a resulting hydrogen rich gas stream 13 is passed to a recycling compressor 14 to be used as a recycle gas 15 in the hydroprocessing reactor. A bottoms stream 8 from the high pressure separator 6, which is in a substantially liquid phase, is cooled and introduced to a low pressure cold separator 9 in which it is separated into a gas stream and a liquid stream 10. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining gas stream 11, which includes hydrogen, $H_2S$, $NH_3$ and any light hydrocarbons such as C1-C4 hydrocarbons, with steam cracker products 44. All or a portion of liquid stream 10 serves as the feed to the steam pyrolysis zone 30.

Steam pyrolysis zone 30 generally comprises a convection section 32 and a pyrolysis section 34 that can operate based on steam pyrolysis unit operations known in the art, i.e., charging the thermal cracking feed to the convection section in the presence of steam. In addition, in certain optional embodiments as described herein (as indicated with dashed lines in FIG. 1), a vapor-liquid separation section 36 is included between sections 32 and 34. Vapor-liquid separation section 36, through which the heated steam cracking feed from convection section 32 passes, can be a separation device based on physical or mechanical separation of vapors and liquids.

In general, an intermediate quenched mixed product stream 44 is subjected to separation in a compression and fractionation section. Such compression and fractionation section are well known in the art.

In one embodiment, the mixed product stream 44 is converted into intermediate product stream 65 and hydrogen 62, which is purified in the present process and used as recycle hydrogen stream 2 in the hydroprocessing reaction zone 4. Intermediate product stream 65, which may further comprise hydrogen, is generally fractioned into end-products and residue in separation zone 70, which can one or multiple separation units such as plural fractionation towers including de-ethanizer, de-propanizer and de-butanizer towers, for example as is known to one of ordinary skill in the art.

In general product separation zone 70 includes an inlet in fluid communication with the product stream 65 and plural product outlets 73-78, including an outlet 78 for discharging methane that optionally may be combined with stream 63, an outlet 77 for discharging ethylene, an outlet 76 for discharging propylene, an outlet 75 for discharging butadiene, an outlet 74 for discharging mixed butylenes, and an outlet 73 for discharging pyrolysis gasoline. Additionally an outlet is provided for discharging pyrolysis fuel oil 71. Optionally, the fuel oil portion 38 from vapor-liquid separation section 36 is combined with pyrolysis fuel oil 71 and can be withdrawn as a pyrolysis fuel oil blend 72, e.g., a low sulfur fuel oil blend to be further processed in an off-site refinery. Note that while six product outlets are shown, fewer or more can be provided depending, for instance, on the arrangement of separation units employed and the yield and distribution requirements.

In an embodiment of a process employing the arrangement shown in FIG. 1, a crude oil feedstock 1 is separated into light fraction 22 and heavy fraction 21 in first separation zone 20. The light fraction 22 is conveyed to the pyrolysis section 36, i.e., bypassing the hydroprocessing zone, to be combined with the portion of the steam cracked intermediate product and to produce a mixed product stream as described herein.

The heavy fraction 21 is mixed with an effective amount of hydrogen 2 and 15 to form a combined stream 3. The admixture 3 is charged to the inlet of selective hydroprocessing reaction zone 4 at a temperature in the range of from 300° C. to 450° C. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 4 includes more than two catalyst beds. In further embodiments hydroprocessing reaction zone 4 includes plural reaction vessels each containing one or more catalyst beds, e.g. of different function.

The hydroprocessing reaction zone 4 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.10 $h^{-1}$ to 10 $h^{-1}$.

Reactor effluents 5 from the hydroprocessing zone 4 are cooled in an exchanger (not shown) and sent to a separators which may comprise a high pressure cold or hot separator 6. Separator tops 7 are cleaned in an amine unit 12 and the resulting hydrogen rich gas stream 13 is passed to a recycling compressor 14 to be used as a recycle gas 15 in the hydroprocessing reaction zone 4. Separator bottoms 8 from the high pressure separator 6, which are in a substantially liquid phase, are cooled and then introduced to a low pressure cold separator 9. Remaining gases, stream 11, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 11 (as indicated by dashed lines) with the cracking gas, stream 44, from the steam cracker products. The bottoms 10 from the low pressure separator 9 are optionally sent to steam pyrolysis zone 30.

The hydroprocessed effluent 10 contains a reduced content of contaminants (i.e., metals, sulfur and nitrogen), an increased paraffinicity, reduced BMCI, and an increased American Petroleum Institute (API) gravity.

The hydrotreated effluent 10 is passed to the convection section 32 and an effective amount of steam is introduced, e.g., admitted via a steam inlet (not shown). In the convection section 32 the mixture is heated to a predetermined temperature, e.g., using one or more waste heat streams or other suitable heating arrangement. The heated mixture of the pyrolysis feedstream and steam is passed to the pyrolysis section 34 to produce a mixed product stream 39. In certain embodiments the heated mixture from section 32 is passed through a vapor-liquid separation section 36 in which a portion 38 is rejected as a low sulfur fuel oil component suitable for blending with pyrolysis fuel oil 71.

The steam pyrolysis zone 30 operates under parameters effective to crack the hydrotreated effluent 10 into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 39 is passed to the inlet of quenching zone 40 with a quenching solution 42 (e.g., water and/or pyrolysis fuel oil) introduced via a separate inlet to produce a quenched mixed product stream 44 having a reduced temperature, e.g., of about 300° C., and spent quenching solution 46 is recycled and/or purged.

The gas mixture effluent 39 from the cracker is typically a mixture of hydrogen, methane, hydrocarbons, carbon dioxide and hydrogen sulfide. After cooling with water and/or oil quench, mixture 44 is subjected to compression and separation. In one non-limiting example, stream 44 is compressed in a multi-stage compressor which typically comprises 4-6 stages, wherein said multi-stage compressor may comprise compressor zone 51 to produce a compressed gas mixture 52. The compressed gas mixture 52 may be treated in a caustic treatment unit 53 to produce a gas mixture 54 depleted of hydrogen sulfide and carbon dioxide. The gas mixture 54 may be further compressed in compressor zone 55. The resulting cracked gas 56 may undergo a cryogenic treatment in unit 57 to be dehydrated, and may be further dried by use of molecular sieves.

The cold cracked gas stream 58 from unit 57 may be passed to a de-methanizer tower 59, from which an overhead stream 60 is produced containing hydrogen and methane from the cracked gas stream. The bottoms stream 65 from de-methanizer tower 59 is then sent for further processing in product separation zone 70, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 59 and hydrogen recovery in unit 61, hydrogen 62 having a purity of typically 80-95 vol % is obtained. Recovery methods in unit 61 include cryogenic recovery (e.g., at a temperature of about −157° C.). Hydrogen stream 62 is then passed to a hydrogen purification unit 64, such as a pressure swing adsorption (PSA) unit to obtain a hydrogen stream 2 having a purity of 99.9%+, or a membrane separation units to obtain a hydrogen stream 2 with a purity of about 95%. The purified hydrogen stream 2 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 63 can optionally be recycled to the steam cracker to be used as fuel for burners and/or heaters.

The bottoms stream 65 from de-methanizer tower 59 is conveyed to the inlet of product separation zone 70 to be separated into methane, ethylene, propylene, butadiene, mixed butylenes and pyrolysis gasoline via outlets 78, 77, 76, 75, 74 and 73, respectively. Pyrolysis gasoline generally includes C5-C9 hydrocarbons, and benzene, toluene and xylenes can be separated from this cut. Optionally one or both of the bottom asphalt phase 29 and the unvaporized heavy liquid fraction 38 from the vapor-liquid separation section 36 are combined with pyrolysis fuel oil 71 (e.g. materials boiling at a temperature higher than the boiling point of the lowest boiling C10 compound, known as a "C10+" stream) from separation zone 70, and the mixed stream is withdrawn as a pyrolysis fuel oil blend 72, e.g. to be further processed in an off-site refinery (not shown).

The present inventors have also found that in most cases the metal components present in the crude oil have already been removed to a certain extent by the hydroprocessing. Consequently, the resid hydrocracking zone is now preferred to be selected from a group consisting of ebulated bed, moving bed and fixed bed type reactor. Preferably, the integrated process as described, e.g., in Embodiment 7 further comprises recovering pyrolysis fuel oil from the combined mixed product stream for use as at least a portion of the heavy components cracked in step (c2). According to this preferred embodiment the present process further comprises separating the hydroprocessed effluent from step (a2) into a vapor phase and a liquid phase in a vapor-liquid separation zone, wherein the vapor phase is thermally cracked in step (b2), and at least a portion of the liquid phase is processed in step (c2). In yet another embodiment step (b2) further comprises heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c2), wherein separating the heated hydroprocessed effluent into a vapor phase and a liquid phase is preferably carried out with a vapor-liquid separation device based on physical and mechanical separation. This integrated hydroprocessing, steam pyrolysis and resid hydrocracking process for direct conversion of crude oil to produce olefinic and aromatic petrochemicals of the present invention preferably further comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics from the remainder of the dehydrated compressed thermally cracked mixed product stream with a reduced content of hydrogen sulfide and carbon dioxide. This integrated process of the present invention preferably further comprises purifying hydrogen from the mixed product stream and recycling it to the step of hydroprocessing. The process of the present invention preferably comprises purifying recovered hydrogen from the dehydrated compressed thermally cracked mixed product stream with a reduced content of hydrogen sulfide and carbon dioxide for recycle to the hydroprocessing zone. The step of recovering hydrogen from the dehydrated compressed thermally cracked mixed product stream with a reduced content of hydrogen sulfide and carbon dioxide further comprises separately recovering methane for use as fuel for burners and/or heaters in the thermal cracking step. This integrated hydroprocessing, steam pyrolysis and resid hydrocracking process preferably further includes the steps of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the thermal cracking step and the gas portion derived from the low pressure separator is combined with the combined product stream after the steam pyrolysis zone and before separation in step (e2). According to a preferred embodiment this process further comprises separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the vapor-liquid separation zone and the gas portion derived from the low pressure separator is combined with the combined product stream after the steam pyrolysis zone and before separation in step (e2).

Figure 2:
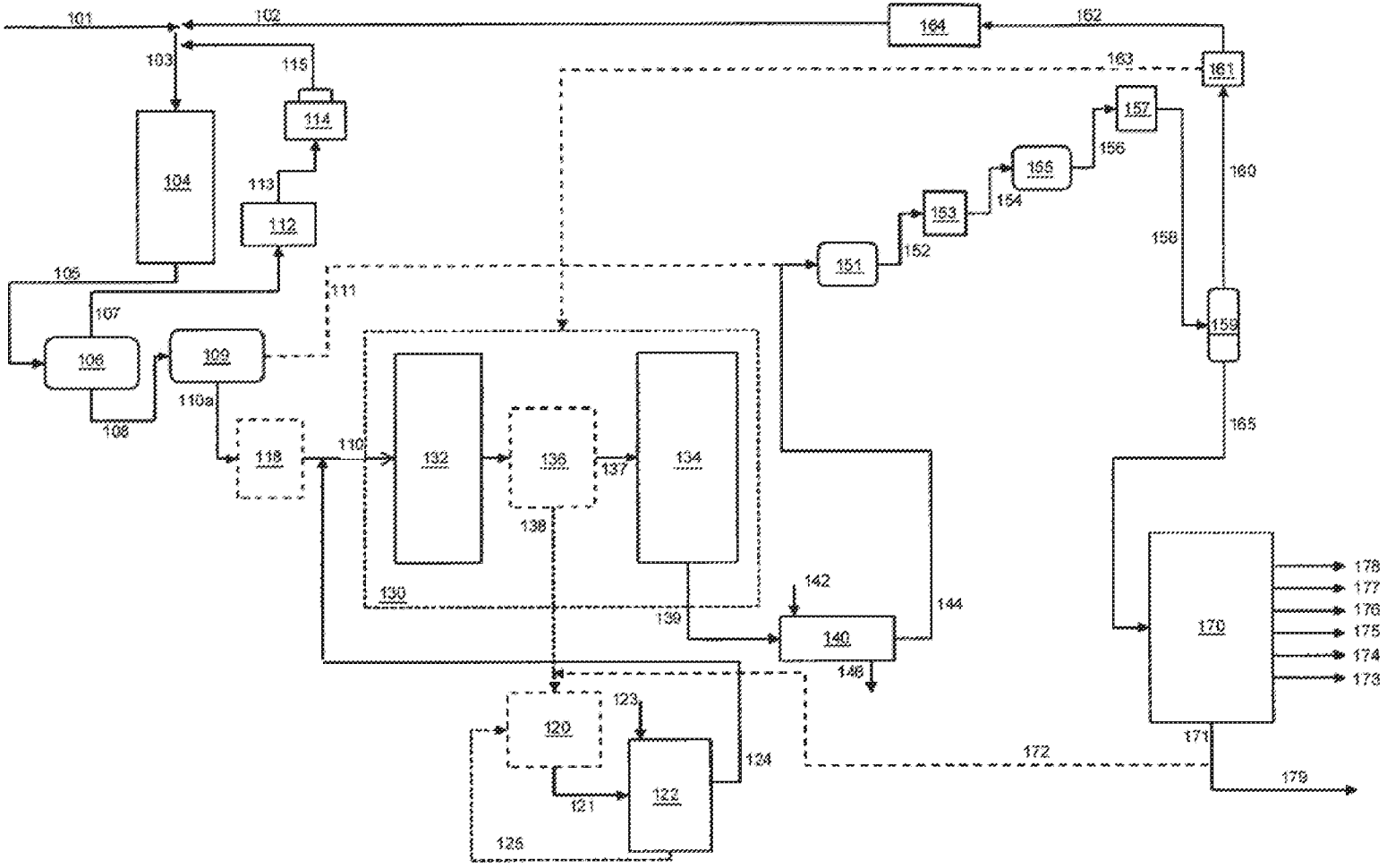
FIG. 2 is a process flow diagram of an embodiment of a process of the invention including integrated hydroprocessing, steam pyrolysis and resid hydrocracking.

A process flow diagram including integrated hydroprocessing, steam pyrolysis and resid hydrocracking as just described is shown FIG. 2, and this integrated system generally includes a selective hydroprocessing zone, a steam pyrolysis zone, a resid hydrocracking zone and a product separation zone. The selective hydroprocessing zone generally includes a hydroprocessing reaction zone 104 having an inlet for receiving a mixture 103 containing a feed 101 and hydrogen 102 recycled from the steam pyrolysis product stream, and make-up hydrogen as necessary (not shown). Hydroprocessing reaction zone 104 further includes an outlet for discharging a hydroprocessed effluent 105.

Reactor effluents 105 from the hydroprocessing reaction zone 104 are cooled in a heat exchanger (not shown) and sent to a high pressure separator 106. The separator tops 107 are cleaned in an amine unit 112 and a resulting hydrogen rich gas stream 113 is passed to a recycling compressor 114 to be used as a recycle gas 115 in the hydroprocessing reactor. A bottoms stream 108 from the high pressure separator 106, which is in a substantially liquid phase, is cooled and introduced to a low pressure cold separator 109, where it is separated into a gas stream and a liquid stream 110. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments of the process and system herein, hydrogen and other hydrocarbons are recovered from stream 11 by combining it with steam cracker products 144 as a combined feed to the product separation zone. All or a portion of liquid stream 110*a* serves as the hydroprocessed cracking feed to the steam pyrolysis zone 130.

Steam pyrolysis zone 130 generally comprises a convection section 132 and a pyrolysis section that can operate based on steam pyrolysis unit operations known in the art, i.e., charging the thermal cracking feed to the convection section in the presence of steam.

In certain embodiments, a vapor-liquid separation zone 136 is included between sections 132 and 134. Vapor-liquid separation zone 136, through which the heated cracking feed from the convection section 132 passes and is fractioned, can be a flash separation device, a separation device based on physical or mechanical separation of vapors and liquids or a combination including at least one of these types of devices.

In additional embodiments, a vapor-liquid separation zone 118 is included upstream of section 132. Stream 110*a* is fractioned into a vapor phase and a liquid phase in vapor-liquid separation zone 118, which can be a flash separation device, a separation device based on physical or mechanical separation of vapors and liquids or a combination including at least one of these types of devices.

In this process, all rejected residuals or bottoms recycled, e.g., streams 119, 138 and 172, have been subjected to the hydroprocessing zone and contain a reduced amount of heteroatom compounds including sulfur-containing, nitrogen-containing and metal compounds as compared to the initial feed. All or a portion of these residual streams can be charged to the resid hydrocracking zone 122 (optionally via the resid hydrocracking blending unit 120) as described herein.

A quenching zone 140 is also integrated downstream of the steam pyrolysis zone 130 and includes an inlet in fluid communication with the outlet of steam pyrolysis zone 130 for receiving mixed product stream 139, an inlet for admitting a quenching solution 142, an outlet for discharging a quenched mixed product stream 144 to the separation zone and an outlet for discharging quenching solution 146.

In general, an intermediate quenched mixed product stream 144 is converted into intermediate product stream 165 and hydrogen 162. The recovered hydrogen is purified and used as recycle hydrogen stream 102 in the hydroprocessing reaction zone. Intermediate product stream 165 is generally fractioned into end-products and residue in separation zone 170, which can be one or multiple separation units, such as plural fractionation towers including de-ethanizer, de-propanizer, and de-butanizer towers as is known to one of ordinary skill in the art.

Product separation zone 170 is in fluid communication with the product stream 165 and includes plural products 173-178, including an outlet 178 for discharging methane, an outlet 177 for discharging ethylene, an outlet 176 for discharging propylene, an outlet 175 for discharging butadiene, an outlet 174 for discharging mixed butylenes, and an outlet 173 for discharging pyrolysis gasoline. Additionally pyrolysis fuel oil 171 is recovered, e.g., as a low sulfur fuel oil blend to be further processed in an off-site refinery. A portion 172 of the discharged pyrolysis fuel oil can be charged to the resid hydrocracking zone (as indicated by dashed lines). Note that while six product outlets are shown along with the hydrogen recycle outlet and the bottoms outlet, fewer or more can be provided depending, for instance, on the arrangement of separation units employed and the yield and distribution requirements.

Resid hydrocracking zone 122 can include existing or improved (i.e., yet to be developed) resid hydrocracking operations (or series of unit operations) that converts the comparably low value residuals or bottoms (e.g., conventionally from the vacuum distillation column or the atmospheric distillation column, and in the present system from the steam pyrolysis zone 130) into relatively lower molecular weight hydrocarbon gases, naphtha, and light and heavy gas oils. The charge to resid hydrocracking zone 122 includes all or a portion of bottoms 119 from vapor-liquid separation zone 118 or all or a portion of bottoms 138 from vapor-liquid separation zone 136. Additionally as described herein all or a portion 172 of pyrolysis fuel oil 171 from product separation zone 170 can be combined as the charge to the resid hydrocracking zone 122.

Resid hydrocracking is an oil refinery processing unit that is suitable for the process of resid hydrocracking, which is a process to convert resid into LPG, light distillate, middle-distillate and heavy-distillate. Resid hydrocracking processes are well known in the art; see e.g. Alfke et al. (2007) loc.cit. In the context of the present invention, two basic reactor types are employed for resid hydrocracking which are a fixed bed (trickle bed) reactor type and an ebullated bed reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated bed hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. In practice the additional costs associated with the ebullated bed reactors are only justified when a high conversion of highly contaminated heavy streams is required. Under these circumstances the limited conversion of very large molecules and the difficulties associated with catalyst deactivation make fixed bed processes relatively unattractive in the process of the present invention. Accordingly, ebullated bed reactor types are preferred due to their improved yield of light- and middle-distillate when compared to fixed bed hydrocracking.

Effective processing conditions for a resid hydroprocessing zone 122 in the system and process herein include a reaction temperature of between 350 and 450° C. and a reaction pressure of between 5-25 MPa gauge. Suitable catalysts typically comprise one or more elements selected from the group consisting of Co, Mo and Ni on a refractory support, typically alumina. Well-known resid hydroprocessing catalysts comprise one group VIII metal (Co or Ni) and one group VI metal (Mo or W) in the sulfide form.

In a process employing the arrangement shown in FIG. 2, feedstock 101 is admixed with an effective amount of hydrogen 102 and 115 (and optionally make-up hydrogen, not shown), and the mixture 103 is charged to the inlet of selective hydroprocessing reaction zone 104 at a temperature in the range of from 300° C. to 450° C. For instance, a hydroprocessing reaction zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 104 includes more than two catalyst beds. In further embodiments hydroprocessing reaction zone 104 includes plural reaction vessels each containing catalyst beds of different function.

Hydroprocessing reaction zone 104 operates under parameters effective to hydrodemetallize, hydrodearomatize, hydrodenitrogenate, hydrodesulfurize and/or hydrocrack the oil feedstock, which in certain embodiments is crude oil. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing reaction zone 104 advantages are demonstrated, for instance, as compared to the same hydroprocessing unit operation employed for atmospheric residue. For instance, at a start or run temperature in the range of 370° C. to 375° C., the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 while that for atmospheric residue is typically $0.25^{h-1}$. An unexpected finding is that the deactivation rate when processing crude oil is going in the inverse direction from that which is usually observed. Deactivation at low throughput ($0.25^{hr-1}$) is 4.2° C./month and deactivation at higher throughput ($0.5^{hr-1}$) is 2.0° C./month. With every feed which is considered in the industry, the opposite is observed. This can be attributed to the washing effect of the catalyst.

Reactor effluents 105 from the hydroprocessing zone 104 are cooled in an exchanger (not shown) and sent to a separators which may comprise a high pressure cold or hot separator 106. Separator tops 107 are cleaned in an amine unit 112 and the resulting hydrogen rich gas stream 113 is passed to a recycling compressor 114 to be used as a recycle gas 115 in the hydroprocessing reaction zone 104. Separator bottoms 108 from the high pressure separator 106, which are in a substantially liquid phase, are cooled and then introduced to a low pressure cold separator 109. Remaining gases, stream 111, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 111 (as indicated by dashed lines) with the cracking gas, stream 144, from the steam cracker products.

In certain embodiments the bottoms stream 110*a* is the feed 110 to the steam pyrolysis zone 130. In further embodiments, bottoms 110*a* from the low pressure separator 109 are sent to separation zone 118 wherein the discharged vapor portion is the feed 110 to the steam pyrolysis zone 130. The vapor portion can have, for instance, an initial boiling point corresponding to that of the stream 110*a* and a final boiling point in the range of about 350° C. to about 600° C. Separation zone 118 can include a suitable vapor-liquid separation unit operation such as a flash vessel, a separation device based on physical or mechanical separation of vapors and liquids or a combination including at least one of these types of devices.

The steam pyrolysis feed 110 contains a reduced content of contaminants (i.e., metals, sulfur and nitrogen), an increased paraffinicity, reduced BMCI, and an increased American Petroleum Institute (API) gravity. The steam pyrolysis feed 110, which contains an increased hydrogen content as compared to the feed 101 is conveyed to the convection section 132 and an effective amount of steam is introduced, e.g., admitted via a steam inlet (not shown). In the convection section 132 the mixture is heated to a predetermined temperature, e.g., using one or more waste heat streams or other suitable heating arrangement. In certain embodiments the mixture is heated to a temperature in the range of from 400° C. to 600° C. and material with a boiling point below the predetermined temperature is vaporized.

The steam pyrolysis zone 130 operates under parameters effective to crack the hydrotreated effluent 110 into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 139 is passed to the inlet of quenching zone 140 with a quenching solution 142 (e.g., water and/or pyrolysis fuel oil) introduced via a separate inlet to produce a quenched mixed product stream 144 having a reduced temperature, e.g., of about 300° C., and spent quenching solution 146 is recycled and/or purged.

The gas mixture effluent 139 from the cracker is typically a mixture of hydrogen, methane, hydrocarbons, carbon dioxide and hydrogen sulfide. After cooling with water and/or oil quench, mixture 144 is subjected to compression and separation. In one non-limiting example, stream 144 is compressed in a multi-stage compressor which typically comprises 4-6 stages, wherein said multi-stage compressor may comprise compressor zone 51 to produce a compressed gas mixture 152. The compressed gas mixture 152 may be treated in a caustic treatment unit 153 to produce a gas mixture 154 depleted of hydrogen sulfide and carbon dioxide. The gas mixture 154 may be further compressed in compressor zone 155. The resulting cracked gas 156 may undergo a cryogenic treatment in unit 157 to be dehydrated, and may be further dried by use of molecular sieves.

The cold cracked gas stream 158 from unit 157 may be passed to a de-methanizer tower 159, from which an overhead stream 160 is produced containing hydrogen and methane from the cracked gas stream. The bottoms stream 165 from de-methanizer tower 159 is then sent for further processing in product separation zone 170, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 159 and hydrogen recovery in unit 161, hydrogen 162 having a purity of typically 80-95 vol % is obtained. Recovery methods in unit 161 include cryogenic recovery (e.g., at a temperature of about −157° C.). Hydrogen stream 162 is then passed to a hydrogen purification unit 164, such as a pressure swing adsorption (PSA) unit to obtain a hydrogen stream 102 having a purity of 99.9%+, or a membrane separation units to obtain a hydrogen stream 102 with a purity of about 95%. The purified hydrogen stream 102 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 163 can optionally be recycled to the steam cracker to be used as fuel for burners and/or heaters.

The bottoms stream 165 from de-methanizer tower 159 is conveyed to the inlet of product separation zone 170 to be separated into methane, ethylene, propylene, butadiene, mixed butylenes and pyrolysis gasoline via outlets 178, 177, 176, 175, 174 and 173, respectively. Pyrolysis gasoline generally includes C5-C9 hydrocarbons, and benzene, toluene and xylenes can be separated from this cut. Optionally one or both of the bottom asphalt phase 129 and the unvaporized heavy liquid fraction 138 from the vapor-liquid separation section 136 are combined with pyrolysis fuel oil 171 (e.g. materials boiling at a temperature higher than the boiling point of the lowest boiling C10 compound, known as a "C10+" stream) from separation zone 170, and the mixed stream is withdrawn as a pyrolysis fuel oil blend 172, e.g. to be further processed in an off-site refinery (not shown). Further, as shown herein, fuel oil 172 (which can be all or a portion of pyrolysis fuel oil 171), can be introduced to the resid hydrocracking zone. The feed to the resid hydrocracking zone includes combinations of streams 119, 138 and/or 172 as described herein. This material is processed in resid hydrocracking zone 122, optionally via a blending zone 120. In the blending zone 120, the residual liquid fraction(s) is/are mixed with a resid unconverted residue. This feed is then upgraded in the resid hydrocracking zone 122 in the presence of hydrogen 123 to produce a resid intermediate product 124 including middle distillates. In certain embodiments the resid hydrocracking zone 122 is under a common high pressure loop with one or more reactors in hydroprocessing zone 104. Resid intermediate product 124 is recycled and mixed with the hydrotreated reactor effluent 10 before processing in the steam pyrolysis zone 130 for conversion.

The steam pyrolysis zone post-quench and separation effluent stream 165 is separated in a series of separation units 170 to produce the principal products 173-178, including methane, ethane, ethylene, propane, propylene, butane, butadiene, mixed butenes, gasoline, and fuel oil. The hydrogen stream 162 is passed through a hydrogen purification unit 164 to form a high quality hydrogen gas 102 for admixture with the feed to the hydroprocessing reaction unit 104.

Figure 3:
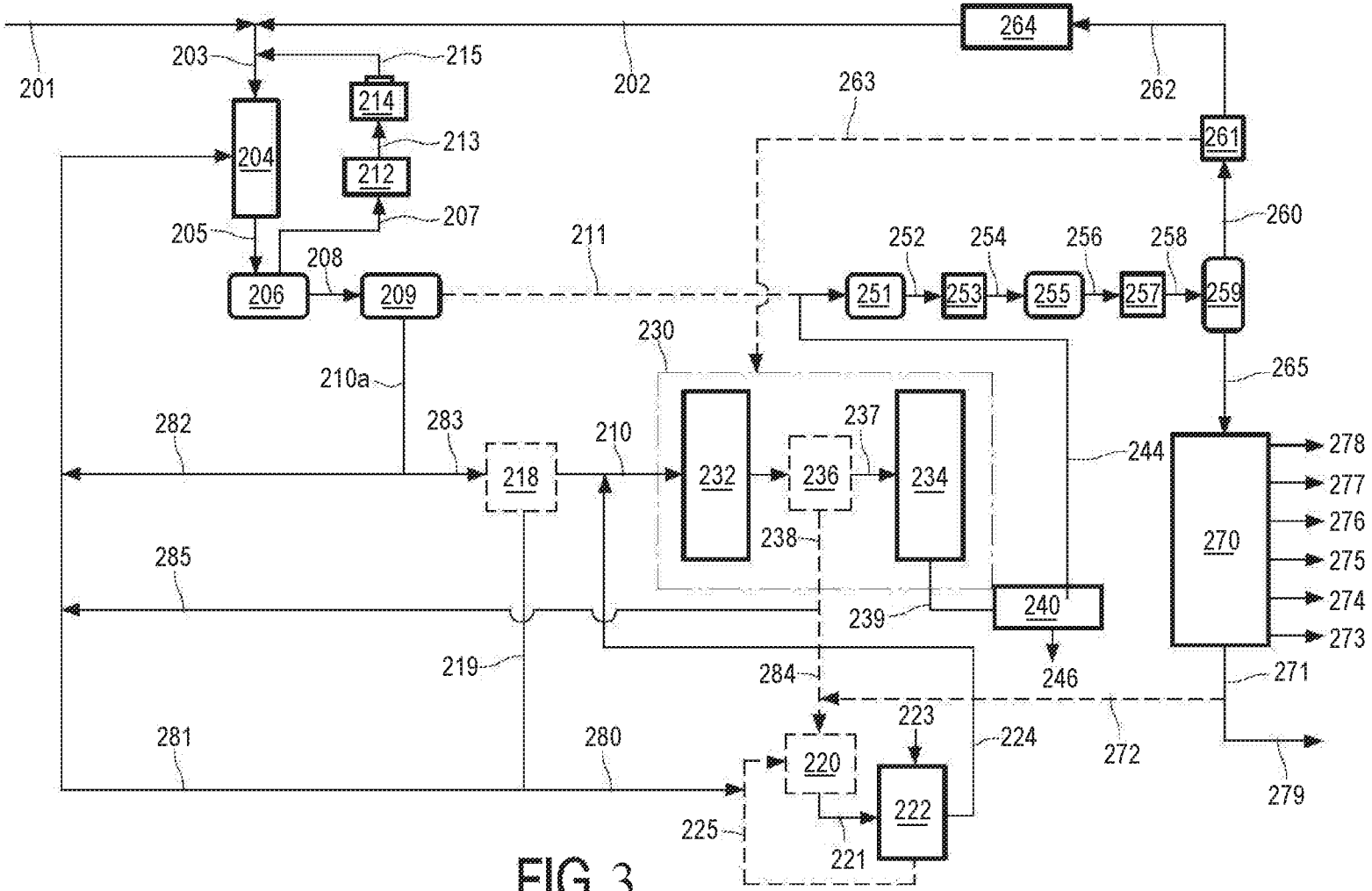
FIG. 3 is a process flow diagram according to a process of the invention including integrated hydroprocessing, steam pyrolysis and slurry hydroprocessing.

As mentioned above, the present invention also relates in part to a an integrated hydroprocessing, steam pyrolysis and slurry hydroprocessing process for direct conversion of crude oil to produce olefinic and aromatic petrochemicals, e.g., such as described in Embodiment 18. In a preferred embodiment the integrated process further comprises recovering pyrolysis fuel oil from the combined mixed product stream for use as at least a portion of the heavy components cracked in step (c3). In a special embodiment this present integrated process further comprises separating the hydroprocessed effluent from step (a3) into a vapor phase and a liquid phase in a vapor-liquid separation zone, wherein the vapor phase is thermally cracked in step (b3), and at least a portion of the liquid phase is processed in step (c3). In another special embodiment of this integrated process step (b3) further comprises heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (a3). In another special embodiment of this integrated process step (b) further comprises heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c3). This integrated process may further comprise discharging the hydroprocessed effluent from step (a3) for use as at least a portion of the heavy components processed in step (a3). Step (e3) of this process preferably further comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics from the remainder of the dehydrated compressed thermally cracked mixed product stream with a reduced content of hydrogen sulfide and carbon dioxide; and step (f3) comprises purifying recovered hydrogen from the dehydrated compressed thermally cracked mixed product stream with a reduced content of hydrogen sulfide and carbon dioxide for recycle to the hydroprocessing zone. In this integrated process according to the present invention recovering hydrogen from the dehydrated compressed thermally cracked mixed product stream with a reduced content of hydrogen sulfide and carbon dioxide further comprises separately recovering methane for use as fuel for burners and/or heaters in the thermal cracking step. In a special embodiment this integrated process further comprises separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the thermal cracking step and the gas portion derived from the low pressure separator is combined with the combined product stream after the steam pyrolysis zone and before separation in step (e3). In yet another special embodiment the integrated process further comprises separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the vapor-liquid separation zone and the gas portion derived from the low pressure separator is combined with the combined product stream after the steam pyrolysis zone and before separation in step (e3). A process flow diagram including integrated hydroprocessing, steam pyrolysis and slurry hydroprocessing according to this embodiment is shown in FIG. 3. The integrated system generally includes a selective hydroprocessing zone, a steam pyrolysis zone, a slurry hydroprocessing zone and a product separation zone.

The selective hydroprocessing zone generally includes a hydroprocessing reaction zone 204 having an inlet for receiving a mixture 203 containing a feed 201 and hydrogen 202 recycled from the steam pyrolysis product stream, and make-up hydrogen as necessary (not shown). Hydroprocessing reaction zone 204 further includes an outlet for discharging a hydroprocessed effluent 205.

Reactor effluents 205 from the hydroprocessing reaction zone 204 are cooled in a heat exchanger (not shown) and sent to separators which may comprise a high pressure cold or hot separator 206. The separator tops 207 are cleaned in an amine unit 212 and a resulting hydrogen rich gas stream 213 is passed to a recycling compressor 214 to be used as a recycle gas 215 in the hydroprocessing reactor. A bottoms stream 208 from the high pressure separator 206, which is in a substantially liquid phase, is cooled and introduced to a low pressure cold separator 209, where it is separated into a gas stream and a liquid stream 210. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments of the process and system herein, hydrogen and other hydrocarbons are recovered from stream 11 by combining it with steam cracker products 244 as a combined feed to the product separation zone. All or a portion of liquid stream 210*a* serves as the hydroprocessed cracking feed to the steam pyrolysis zone 230.

At least a portion of liquid stream 210*a* can be charged as a feed 282 to the hydroprocessing reaction zone 204.

At least a portion of liquid stream 210*a* can be charged as a feed 283 to the steam pyrolysis zone 230.

Steam pyrolysis zone 230 generally comprises a convection section 232 and a pyrolysis section that can operate based on steam pyrolysis unit operations known in the art, i.e., charging the thermal cracking feed to the convection section in the presence of steam.

In certain embodiments, a vapor-liquid separation zone 236 is included between sections 232 and 234. Vapor-liquid separation zone 236, through which the heated cracking feed from the convection section 232 passes and is fractioned, can be a flash separation device, a separation device based on physical or mechanical separation of vapors and liquids or a combination including at least one of these types of devices.

In additional embodiments, a vapor-liquid separation zone 218 is included upstream of section 232. Stream 210*a* is fractioned into a vapor phase and a liquid phase in vapor-liquid separation zone 218, which can be a flash separation device, a separation device based on physical or mechanical separation of vapors and liquids or a combination including at least one of these types of devices.

In general vapor is swirled in a circular pattern to create forces where heavier droplets and liquid are captured and channeled through to a liquid outlet as liquid residue which can be passed to slurry hydroprocessing zone 222 (optionally via the slurry hydroprocessing blending unit 220), and vapor is channeled through a vapor outlet. In embodiments in which a vapor-liquid separations device 236 is provided, the liquid phase 238 is discharged as residue and the vapor phase is the charge 237 to the pyrolysis section 234.

At least a part of this residue 238 is processed as a feed 284 for slurry bed hydroprocessing zone 222. At least a part of this residue 238 is also processed as a feed 285 for hydroprocessing reaction zone 204.

In embodiments in which a vapor-liquid separation device 218 is provided, the liquid phase 219 is discharged as the residue and the vapor phase is the charge 210 to the convection section 232. The vaporization temperature and fluid velocity are varied to adjust the approximate temperature cutoff point, for instance in certain embodiments compatible with the residue fuel oil blend, e.g. about 540° C.

At least a part of the liquid phase 219 stream can be charged as a feed 280 to the slurry hydroprocessing zone 222 (optionally via the slurry hydroprocessing blending unit 220) as described herein.

At least a part of the liquid phase 219 stream can be charged as a feed 281 to the hydroprocessing reaction zone 204.

In the process herein, all rejected residuals or bottoms recycled, e.g., streams 219, 238 and 272, have been subjected to the hydroprocessing zone and contain a reduced amount of heteroatom compounds including sulfur-containing, nitrogen-containing and metal compounds as compared to the initial feed. All or a portion of these residual streams can be charged to the slurry hydroprocessing zone 222 (optionally via the slurry hydroprocessing blending unit 220) as described herein.

A quenching zone 240 is also integrated downstream of the steam pyrolysis zone 230 and includes an inlet in fluid communication with the outlet of steam pyrolysis zone 230 for receiving mixed product stream 239, an inlet for admitting a quenching solution 242, an outlet for discharging a quenched mixed product stream 244 to the separation zone and an outlet for discharging quenching solution 246.

In general, an intermediate quenched mixed product stream 244 subjected to separation in a compression and fractionation section. Such compression and fractionation section are well known in the art.

In another preferred embodiment of the invention the mixed product stream 244 is converted into intermediate product stream 265 and hydrogen 262. The recovered hydrogen is purified and used as recycle hydrogen stream 202 in the hydroprocessing reaction zone. Intermediate product stream 265, which may further comprise hydrogen, is generally fractioned into end-products and residue in separation zone 270, which can be one or multiple separation units, such as plural fractionation towers including de-ethanizer, de-propanizer, and de-butanizer towers as is known to one of ordinary skill in the art.

Product separation zone 270 is in fluid communication with the product stream 265 and includes plural products 273-278, including an outlet 278 for discharging methane that optionally may be combined with stream 63, an outlet 277 for discharging ethylene, an outlet 276 for discharging propylene, an outlet 275 for discharging butadiene, an outlet 274 for discharging mixed butylenes, and an outlet 273 for discharging pyrolysis gasoline. Additionally pyrolysis fuel oil 271 is recovered, e.g., as a low sulfur fuel oil blend to be further processed in an off-site refinery. A portion 272 of the discharged pyrolysis fuel oil can be charged to the slurry hydroprocessing zone (as indicated by dashed lines). Note that while six product outlets are shown along with the hydrogen recycle outlet and the bottoms outlet, fewer or more can be provided depending, for instance, on the arrangement of separation units employed and the yield and distribution requirements.

Slurry hydroprocessing zone 222 can include existing or improved (i.e., yet to be developed) slurry hydroprocessing operations (or series of unit operations) that converts the comparably low value residuals or bottoms (e.g., conventionally from the vacuum distillation column or the atmospheric distillation column, and in the present system from the steam pyrolysis zone 230) into relatively lower molecular weight hydrocarbon gases, naphtha, and light and heavy gas oils. The charge to slurry hydroprocessing zone 222 includes all or a portion of bottoms 219 (as feed 280) from vapor-liquid separation zone 218 or all or a portion of bottoms 238 from vapor-liquid separation zone 236. Additionally as described herein all or a portion 272 of pyrolysis fuel oil 271 from product separation zone 270 can be combined as the charge to fluidized catalytic cracking zone 225.

Slurry bed reactor unit operations are characterized by the presence of catalyst particles having very small average dimensions that can be efficiently dispersed uniformly and maintained in the medium, so that the hydrogenation processes are efficient and immediate throughout the volume of the reactor. Slurry phase hydroprocessing operates at relatively high temperatures (400° C.-500° C.) and high pressures (100 bars-230 bars). Because of the high severity of the process, a relatively higher conversion rate can be achieved. The catalysts can be homogeneous or heterogeneous and are designed to be functional at high severity conditions. The mechanism is a thermal cracking process and is based on free radical formation. The free radicals formed are stabilized with hydrogen in the presence of catalysts, thereby preventing the coke formation. The catalysts facilitate the partial hydrogenation of heavy feedstock prior to cracking and thereby reduce the formation of longer chain compounds.

The catalysts used in the slurry hydrocracking process can be small particles or can be introduced as an oil soluble precursor, generally in the form of a sulfide of the metal that is formed during the reaction or in a pretreatment step. The metals that make up the dispersed catalysts are generally one or more transition metals, which can be selected from Mo, W, Ni, Co and/or Ru. Molybdenum and tungsten are especially preferred since their performance is superior to vanadium or iron, which in turn are preferred over nickel, cobalt or ruthenium. The catalysts can be used at a low concentration, e.g., a few hundred parts per million (ppm), in a once-through arrangement, but are not especially effective in upgrading of the heavier products under those conditions. To obtain better product quality, catalysts are used at higher concentration, and it is necessary to recycle the catalyst in order to make the process sufficiently economical. The catalysts can be recovered using methods such as settling, centrifugation or filtration.

In general, a slurry bed reactor can be a two-or-three phase reactor, depending on the type of catalysts utilized. It can be a two-phase system of gas and liquid when the homogeneous catalysts are employed or a three-phase system of gas, liquid and solid when small particle size heterogeneous catalysts are employed. The soluble liquid precursor or small particle size catalysts permit high dispersion of catalysts in the liquid and produce an intimate contact between the catalysts and feedstock resulting in a high conversion rate.

Effective processing conditions for a slurry bed hydroprocessing zone 222 in the system and process herein include a reaction temperature of between 375 and 450° C. and a reaction pressure of between 30 and 180 bars. Suitable catalysts include unsupported nano size active particles produced in situ from oil soluble catalyst precursors, including, for example one group VIII metal (Co or Ni) and one group VI metal (Mo or W) in the sulfide form.

In a process employing the arrangement shown in FIG. 3, feedstock 201 is admixed with an effective amount of hydrogen 202 and 215 (and optionally make-up hydrogen, not shown), and the mixture 203 is charged to the inlet of selective hydroprocessing reaction zone 204 at a temperature in the range of from 300° C. to 450° C. For instance, a hydroprocessing reaction zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 204 includes more than two catalyst beds. In further embodiments hydroprocessing reaction zone 204 includes plural reaction vessels each containing catalyst beds of different function.

Hydroprocessing reaction zone 204 operates under parameters effective to hydrodemetallize, hydrodearomatize, hydrodenitrogenate, hydrodesulfurize and/or hydrocrack the oil feedstock, which in certain embodiments is crude oil. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing reaction zone 204 advantages are demonstrated, for instance, as compared to the same hydroprocessing unit operation employed for atmospheric residue. For instance, at a start or run temperature in the range of 370° C. to 375° C., the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 $h^{-1}$ while that for atmospheric residue is typically 0.25 $h^{-1}$. An unexpected finding is that the deactivation rate when processing crude oil is going in the inverse direction from that which is usually observed. Deactivation at low throughput (0.25 hr<−1>) is 4.2° C./month and deactivation at higher throughput (0.5 hr<−1>) is 2.0° C./month. With every feed which is considered in the industry, the opposite is observed. This can be attributed to the washing effect of the catalyst.

Reactor effluents 205 from the hydroprocessing zone 204 are cooled in an exchanger (not shown) and sent to a high pressure cold or hot separator 206. Separator tops 7 are cleaned in an amine unit 212 and the resulting hydrogen rich gas stream 213 is passed to a recycling compressor 214 to be used as a recycle gas 215 in the hydroprocessing reaction zone 204. Separator bottoms 208 from the high pressure separator 206, which are in a substantially liquid phase, are cooled and then introduced to a low pressure cold separator 209. Remaining gases, stream 211, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 211 (as indicated by dashed lines) with the cracking gas, stream 244 from the steam cracker products.

In certain embodiments the bottoms stream 210*a*, as stream 283, is the feed 210 to the steam pyrolysis zone 230.

In further embodiments, bottoms 210*a* from the low pressure separator 209 are sent to separation zone 218 wherein the discharged vapor portion is the feed 210 to the steam pyrolysis zone 230. The vapor portion can have, for instance, an initial boiling point corresponding to that of the stream 210*a* and a final boiling point in the range of about 350° C. to about 600° C. Separation zone 218 can include a suitable vapor-liquid separation unit operation such as a flash vessel, a separation device based on physical or mechanical separation of vapors and liquids or a combination including at least one of these types of devices.

The steam pyrolysis feed 210 contains a reduced content of contaminants (i.e., metals, sulfur and nitrogen), an increased paraffinicity, reduced BMCI, and an increased American Petroleum Institute (API) gravity. The steam pyrolysis feed 210, which contains an increased hydrogen content as compared to the feed 201 is conveyed to the convection section 232 and an effective amount of steam is introduced, e.g., admitted via a steam inlet (not shown). In the convection section 232 the mixture is heated to a predetermined temperature, e.g., using one or more waste heat streams or other suitable heating arrangement. In certain embodiments the mixture is heated to a temperature in the range of from 400° C. to 600° C. and material with a boiling point below the predetermined temperature is vaporized.

The steam pyrolysis zone 230 operates under parameters effective to crack the hydrotreated effluent 210 into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 239 is passed to the inlet of quenching zone 240 with a quenching solution 242 (e.g., water and/or pyrolysis fuel oil) introduced via a separate inlet to produce a quenched mixed product stream 244 having a reduced temperature, e.g., of about 300° C., and spent quenching solution 246 is recycled and/or purged.

The gas mixture effluent 239 from the cracker is typically a mixture of hydrogen, methane, hydrocarbons, carbon dioxide and hydrogen sulfide. After cooling with water and/or oil quench, mixture 244 is subjected to compression and separation. In one non-limiting example, stream 244 is compressed in a multi-stage compressor which typically comprises 4-6 stages, wherein said multi-stage compressor may comprise compressor zone 251 to produce a compressed gas mixture 252. The compressed gas mixture 252 may be treated in a caustic treatment unit 253 to produce a gas mixture 254 depleted of hydrogen sulfide and carbon dioxide. The gas mixture 254 may be further compressed in compressor zone 255. The resulting cracked gas 256 may undergo a cryogenic treatment in unit 257 to be dehydrated, and may be further dried by use of molecular sieves.

The cold cracked gas stream 258 from unit 257 may be passed to a de-methanizer tower 259, from which an overhead stream 260 is produced containing hydrogen and methane from the cracked gas stream. The bottoms stream 265 from de-methanizer tower 259 is then sent for further processing in product separation zone 270, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 259 and hydrogen recovery in unit 261, hydrogen 262 having a purity of typically 80-95 vol % is obtained. Recovery methods in unit 261 include cryogenic recovery (e.g., at a temperature of about −157° C.). Hydrogen stream 262 is then passed to a hydrogen purification unit 264, such as a pressure swing adsorption (PSA) unit to obtain a hydrogen stream 202 having a purity of 99.9%+, or a membrane separation units to obtain a hydrogen stream 202 with a purity of about 95%. The purified hydrogen stream 202 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 263 can optionally be recycled to the steam cracker to be used as fuel for burners and/or heaters.

The bottoms stream 265 from de-methanizer tower 259 is conveyed to the inlet of product separation zone 270 to be separated into methane, ethylene, propylene, butadiene, mixed butylenes and pyrolysis gasoline via outlets 278, 277, 276, 275, 274 and 273, respectively. Pyrolysis gasoline generally includes C5-C9 hydrocarbons, and benzene, toluene and xylenes can be separated from this cut. Optionally one or both of the bottom asphalt phase 229 and the unvaporized heavy liquid fraction 238 from the vapor-liquid separation section 236 are combined with pyrolysis fuel oil 271 (e.g. materials boiling at a temperature higher than the boiling point of the lowest boiling C10 compound, known as a "C10+" stream) from separation zone 270, and the mixed stream is withdrawn as a pyrolysis fuel oil blend 272, e.g. to be further processed in an off-site refinery (not shown). Further, as shown herein, fuel oil 272 (which can be all or a portion of pyrolysis fuel oil 271), can be introduced to the slurry hydroprocessing zone 222 via a blending zone 220.

The feed to the slurry hydroprocessing zone includes combinations of streams 280, 284 and/or 272 as described herein. This material is processed in slurry hydroprocessing zone 222, optionally via a blending zone 220. In the blending zone 220, the residual liquid fraction(s) is/are mixed with a slurry unconverted residue 225 that include the catalyst active particles to form the feed of the slurry hydroprocessing zone 222. This feed is then upgraded in the slurry hydroprocessing zone 222 in the presence of hydrogen 223 to produce a slurry intermediate product 224 including middle distillates. In certain embodiments the slurry hydroprocessing zone 222 is under a common high pressure loop with one or more reactors in hydroprocessing zone 204. Slurry intermediate product 224 is recycled and mixed with the hydrotreated reactor effluent 210 before processing in the steam pyrolysis zone 230 for conversion.

The steam pyrolysis zone post-quench and separation effluent stream 265 is separated in a series of separation units 270 to produce the principal products 273-278, including methane, ethane, ethylene, propane, propylene, butane, butadiene, mixed butenes, gasoline, and fuel oil. The hydrogen stream 262 is passed through a hydrogen purification unit 264 to form a high quality hydrogen gas 202 for admixture with the feed to the hydroprocessing reaction unit 204.

According to a preferred embodiment according to embodiment 28 described above at least a part of the heavy fraction is blended with pyrolysis fuel oil recovered in step (f4). In the present integrated process step (c4) preferably comprises the steps of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e4) and pyrolysis fuel oil as in step (f4) from the remainder of the dehydrated compressed thermally cracked mixed product stream with a reduced content of hydrogen sulfide and carbon dioxide; and step (d4) comprises purifying recovered hydrogen from the dehydrated compressed thermally cracked mixed product stream with a reduced content of hydrogen sulfide and carbon dioxide for recycle to the hydroprocessing zone. The step of recovering hydrogen from the dehydrated compressed thermally cracked mixed product stream with a reduced content of hydrogen sulfide and carbon dioxide preferably comprises separately recovering methane for use as fuel for burners and/or heaters in the thermal cracking step. The thermal cracking step of the embodiment preferably comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction, wherein the discharged liquid fraction is preferably blended with pyrolysis fuel oil recovered in step (f4). This integrated process preferably comprises separating the hydroprocessing zone reactor effluents in a high pressure separator to recover a gas portion that is cleaned and recycled to the hydroprocessing zone as an additional source of hydrogen, and liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (c4). In a special embodiment this integrated process further comprises the steps of separating the hydroprocessing zone reactor effluents in a high pressure separator to recover a gas portion that is cleaned and recycled to the hydroprocessing zone as an additional source of hydrogen, and liquid portion, separating the liquid portion from the high pressure separator in a low pressure separator into a gas portion and a liquid portion, wherein the liquid portion from the low pressure separator is the hydroprocessed effluent subjected to separation into a light fraction and a heavy fraction, and the gas portion from the low pressure separator is combined with the mixed product stream after the steam pyrolysis zone and before separation in step (c4).

Figure 4:
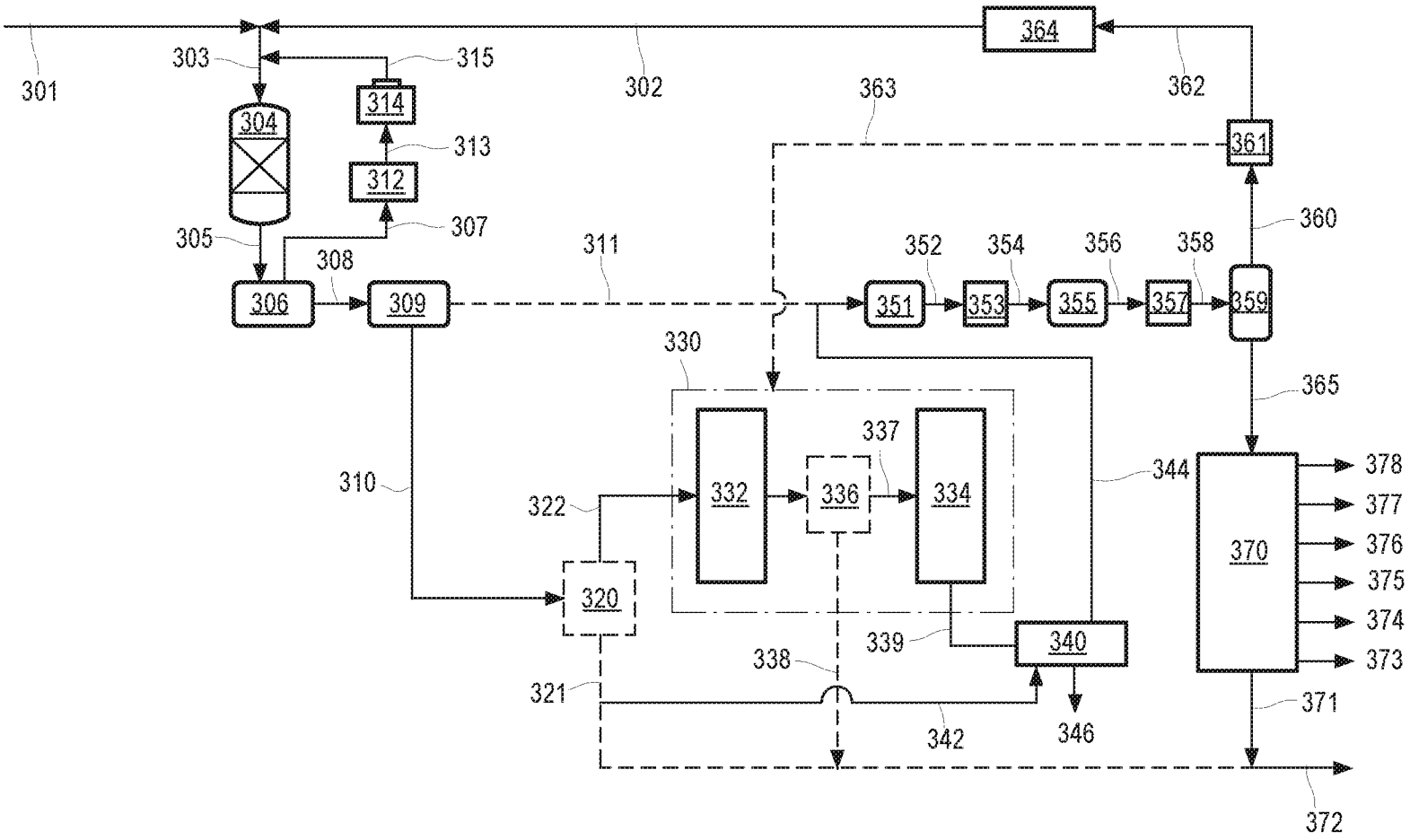
FIG. 4 is a process flow diagram including an integrated hydroprocessing and steam pyrolysis process and system.

A process flow diagram of this embodiment including an integrated hydroprocessing and steam pyrolysis process and system is shown in FIG. 4. The integrated system generally includes a selective catalytic hydroprocessing zone, an optional separation zone 320, a steam pyrolysis zone 330 and a product separation zone. Selective hydroprocessing zone includes a hydroprocessing reaction zone 304 having an inlet for receiving a mixture of crude oil feed 301 and hydrogen 302 recycled from the steam pyrolysis product stream, and make-up hydrogen as necessary. Hydroprocessing reaction zone 304 further includes an outlet for discharging a hydroprocessed effluent 305.

Reactor effluents 305 from the hydroprocessing reactor(s) are cooled in a heat exchanger (not shown) and sent to a high pressure separator 306. The separator tops 307 are cleaned in an amine unit 312 and a resulting hydrogen rich gas stream 313 is passed to a recycling compressor 314 to be used as a recycle gas 315 in the hydroprocessing reactor. A bottoms stream 308 from the high pressure separator 306, which is in a substantially liquid phase, is cooled and introduced to a low pressure cold separator 309 in which it is separated into a gas stream and a liquid stream 310. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining stream gas stream 311, which includes hydrogen, $H_2S$, $NH_3$ and any light hydrocarbons such as C1-C4 hydrocarbons, with steam cracker products 344. All or a portion of liquid stream 310 serves as the feed to the steam pyrolysis zone 330.

The separation zone 320 (as indicated with dashed lines in the figure) is employed to remove heavy ends of the bottoms stream 310 from low pressure separator 309, i.e., the liquid phase hydroprocessing zone effluents. Separation zone 320 generally includes an inlet receiving liquid stream 310, an outlet for discharging a light fraction 322 comprising light components and an outlet for discharging a heavy fraction 321 comprising heavy components, which can be combined with pyrolysis fuel oil from product separation zone 370, or can be used as a quench oil 342 in quenching zone 340. In certain embodiments, separation zone 320 includes one or more flash vessels.

In additional embodiments separation zone 320 includes, or consists essentially of (i.e., operates in the absence of a flash zone), a cyclonic phase separation device, or other separation device based on physical or mechanical separation of vapors and liquids. In embodiments in which the separation zone includes or consist essentially of a separation device based on physical or mechanical separation of vapors and liquids, the cut point can be adjusted based on vaporization temperature and the fluid velocity of the material entering the device, for example, to remove a fraction in the range of vacuum residue.

Steam pyrolysis zone 330 generally comprises a convection section 332 and a pyrolysis section 334 that can operate based on steam pyrolysis unit operations known in the art, i.e., charging the thermal cracking feed to the convection section in the presence of steam. In addition, in certain optional embodiments as described herein (as indicated with dashed lines in the figure), a vapor-liquid separation section 336 is included between sections 332 and 334. Vapor-liquid separation section 336, through which the heated steam cracking feed from convection section 332 passes, can be a separation device based on physical or mechanical separation of vapors and liquids.

In general vapor is swirled in a circular pattern to create forces where heavier droplets and liquid are captured and channeled through to a liquid outlet as fuel oil 338, for instance, which is added to a pyrolysis fuel oil blend, and vapor is channeled through a vapor outlet as the charge 337 to the pyrolysis section 334. The vaporization temperature and fluid velocity are varied to adjust the approximate temperature cutoff point, for instance in certain embodiments compatible with the residue fuel oil blend, e.g., about 540° C.

A quenching zone 340 includes an inlet in fluid communication with the outlet of steam pyrolysis zone 330, an inlet for admitting a quenching medium 342, an outlet for discharging an intermediate quenched mixed product stream 344 and an outlet for discharging quenching medium 346.

In general, an intermediate quenched mixed product stream 344 is subjected to separation in a compression and fractionation section. Such compression and fractionation section are well known in the art.

In one embodiment, the mixed product stream 344 is converted into intermediate product stream 365 and hydrogen 362, which is purified in the present process and used as recycle hydrogen stream 2 in the hydroprocessing reaction zone 304. Intermediate product stream 365, which may further comprise hydrogen, is generally fractioned into end-products and residue in separation zone 370, which can one or multiple separation units such as plural fractionation towers including de-ethanizer, de-propanizer and de-butanizer towers, for example as is known to one of ordinary skill in the art.

In general product separation zone 370 includes an inlet in fluid communication with the product stream 365 and plural product outlets 373-378, including an outlet 378 for discharging methane that optionally may be combined with stream 363, an outlet 377 for discharging ethylene, an outlet 76 for discharging propylene, an outlet 375 for discharging butadiene, an outlet 74 for discharging mixed butylenes, and an outlet 373 for discharging pyrolysis gasoline. Additionally an outlet is provided for discharging pyrolysis fuel oil 371. Optionally, one or both of the heavy fraction 321 from flash zone 320 and the fuel oil portion 338 from vapor-liquid separation section 336 are combined with pyrolysis fuel oil 371 and can be withdrawn as a pyrolysis fuel oil blend 372, e.g., a low sulfur fuel oil blend to be further processed in an off-site refinery. At least a part of heavy fraction 321 from flash zone 320 is used as a quench oil 342. Note that while six product outlets are shown, fewer or more can be provided depending, for instance, on the arrangement of separation units employed and the yield and distribution requirements.

In an embodiment of a process employing the arrangement shown in FIG. 4, a crude oil feedstock 301 is admixed with an effective amount of hydrogen 302 and 315 and the mixture 303 is charged to the inlet of selective hydroprocessing reaction zone 304 at a temperature in the range of from 300° C. to 450° C. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 304 includes more than two catalyst beds. In further embodiments hydroprocessing reaction zone 304 includes plural reaction vessels each containing one or more catalyst beds, e.g., of different function.

Hydroprocessing reaction zone 304 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing zone advantages are demonstrated, for instance, as compared to the same hydroprocessing unit operation employed for atmospheric residue. For instance, at a start or run temperature in the range of 370° C. to 375° C., the deactivation rate is around 1 T/month. In contrast, if residue were to be processed, the deactivation rate would be closer to about 3 T/month to 4 T/month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 while that for atmospheric residue is typically 0.25. An unexpected finding is that the deactivation rate when processing crude oil is going in the inverse direction from that which is usually observed. Deactivation at low throughput (0.25 $hr^{-1}$) is 4.2 T/month and deactivation at higher throughput (0.5 $hr^{-1}$) is 2.0 T/month. With every feed which is considered in the industry, the opposite is observed. This can be attributed to the washing effect of the catalyst.

Reactor effluents 305 from the hydroprocessing zone 304 are cooled in an exchanger (not shown) and sent to separators which may comprise a high pressure cold or hot separator 306. Separator tops 307 are cleaned in an amine unit 312 and the resulting hydrogen rich gas stream 313 is passed to a recycling compressor 314 to be used as a recycle gas 315 in the hydroprocessing reaction zone 304. Separator bottoms 308 from the high pressure separator 306, which are in a substantially liquid phase, are cooled and then introduced to a low pressure cold separator 309. Remaining gases, stream 311, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 311 (as indicated by dashed lines) with the cracking gas, stream 344, from the steam cracker products. The bottoms 310 from the low pressure separator 309 are optionally sent to separation zone 320 or passed directly to steam pyrolysis zone 330.

The hydroprocessed effluent 310 contains a reduced content of contaminants (i.e., metals, sulfur and nitrogen), an increased paraffinicity, reduced BMCI, and an increased American Petroleum Institute (API) gravity. The hydroprocessed effluent 310 is conveyed to separation zone 320 to remove heavy ends as bottoms stream 321 and provide the remaining lighter cut as pyrolysis feed 322.

At least a part of bottoms stream 321 is used as a quench oil 342 in quenching zone 340.

The pyrolysis feedstream, e.g. having an initial boiling point corresponding to that of the feed and a final boiling point in the range of about 370° C. to about 600° C., is conveyed to the inlet of a convection section 332 and an effective amount of steam is introduced, e.g., admitted via a steam inlet. In the convection section 332 the mixture is heated to a predetermined temperature, e.g., using one or more waste heat streams or other suitable heating arrangement. The heated mixture of the pyrolysis feedstream and steam is passed to the pyrolysis section 334 to produce a mixed product stream 339. In certain embodiments the heated mixture of from section 332 is passed through a vapor-liquid separation section 336 in which a portion 338 is rejected as a fuel oil component suitable for blending with pyrolysis fuel oil 371.

The steam pyrolysis zone 330 operates under parameters effective to crack fraction 322 (or effluent 310 in embodiments in which separation zone 320 is not employed) into the desired products including ethylene, propylene, butadiene, mixed butenes and pyrolysis gasoline. In certain embodiments, steam cracking in the pyrolysis section is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 339 is passed to the inlet of quenching zone 340 with a quenching medium 342 (and optionally also water) introduced via a separate inlet to produce an intermediate quenched mixed product stream 344 having a reduced temperature, e.g., of about 300° C., and spent quenching medium 346 is recycled and/or purged.

The gas mixture effluent 339 from the cracker is typically a mixture of hydrogen, methane, hydrocarbons, carbon dioxide and hydrogen sulfide. After cooling with quenching medium, mixture 344 is subjected to compression and separation. In one non-limiting example, stream 344 is compressed in a multi-stage compressor which typically comprises 4-6 stages, wherein said multi-stage compressor may comprise compressor zone 351, to produce a compressed gas mixture 352. The compressed gas mixture 352 may be treated in a caustic treatment unit 53 to produce a gas mixture 54 depleted of hydrogen sulfide and carbon dioxide. The gas mixture 354 may be further compressed in a compressor zone 355. The resulting cracked gas 356 may undergo a cryogenic treatment in unit 357 to be dehydrated, and may be further dried by use of molecular sieves.

The cold cracked gas stream 358 from unit 357 may be passed to a de-methanizer tower 359, from which an overhead stream 360 is produced containing hydrogen and methane from the cracked gas stream. The bottoms stream 365 from de-methanizer tower 359 is then sent for further processing in product separation zone 370, comprising fractionation towers including de-ethanizer, de-propanizer and de-butanizer towers. Process configurations with a different sequence of de-methanizer, de-ethanizer, de-propanizer and de-butanizer can also be employed.

After separation from methane at the de-methanizer tower 359 and hydrogen recovery in unit 361, hydrogen 362 having a purity of typically 80-95 vol % is obtained. Recovery methods in unit 361 include cryogenic recovery (e.g., at a temperature of about −157° C.). Hydrogen stream 362 is then passed to a hydrogen purification unit 64, such as a pressure swing adsorption (PSA) unit to obtain a hydrogen stream 302 having a purity of 99.9%+, or a membrane separation units to obtain a hydrogen stream 302 with a purity of about 95%. The purified hydrogen stream 302 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 363 can optionally be recycled to the steam cracker to be used as fuel for burners and/or heaters.

The bottoms stream 365 from de-methanizer tower 359 is conveyed to the inlet of product separation zone 370 to be separated into methane, ethylene, propylene, butadiene, mixed butylenes and pyrolysis gasoline discharged via outlets 378, 377, 376, 375, 374 and 373, respectively. Pyrolysis gasoline generally includes C5-C9 hydrocarbons, and benzene, toluene and xylenes can be separated from this cut. Optionally, one or both of the unvaporized heavy liquid fraction 321 from flash zone 320 and the rejected portion 38 from vapor-liquid separation section 336 are combined with pyrolysis fuel oil 371 (e.g., materials boiling at a temperature higher than the boiling point of the lowest boiling C10 compound, known as a "C10+" stream) and the mixed stream can be withdrawn as a pyrolysis fuel oil blend 372, e.g., a low sulfur fuel oil blend to be further processed in an off-site refinery.

As mentioned before at least a part of heavy liquid fraction 321 from flash zone 320 is used as quench oil in quenching zone 340.

The systems described herein, especially as described in Embodiment 1, also decreases solution losses and decreases $H_2$ consumption. This makes possible the operation of such a system as closed or near-closed system.

In certain embodiments, selective hydroprocessing or hydrotreating processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenation.

In one embodiment of the invention, the sequence of catalysts to perform hydrodemetallization (HDM) and hydrodesulfurization (HDS) is as follows:

a. A hydrodemetallization catalyst. The catalyst in the HDM section is generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically the active metals on the catalyst surface are sulfides of nickel and molybdenum in the ratio Ni/Ni+Mo<0.15. The concentration of nickel is lower on the HDM catalyst than other catalysts as some nickel and vanadium is anticipated to be deposited from the feedstock itself during the removal, acting as catalyst. The dopant used can be one or more of phosphorus (see, e.g., United States Patent Publication Number US 2005/0211603 which is incorporated by reference herein), boron, silicon and halogens. The catalyst can be in the form of alumina extrudates or alumina beads. In certain embodiments alumina beads are used to facilitate un-loading of the catalyst HDM beds in the reactor as the metals uptake will range between from 30 to 100% at the top of the bed.

b. An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm.

c. The catalyst in the HDS section can include those having gamma alumina based support materials, with typical surface area towards the higher end of the HDM range, e.g. about ranging from 180-240 $m^2/g$. This required higher surface for HDS results in relatively smaller pore volume, e.g., lower than 1 $cm^3/g$. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85.

d. A final catalyst (which could optionally replace the second and third catalyst) is designed to perform hydrogenation of the feedstock (rather than a primary function of hydrodesulfurization), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$. This required higher surface for HDS results in relatively smaller pore volume, e.g., lower than 1 $cm^3/g$.

Methods and systems described herein provide improvements over known steam pyrolysis cracking processes, including the ability to use crude oil as a feedstock to produce petrochemicals such as olefins and aromatics. Furthermore, impurities such as metals, sulfur and nitrogen compounds are also preferably significantly removed from the starting feed which avoids post treatments of the final products.

In addition, hydrogen produced from the steam cracking zone is recycled to the hydroprocessing zone to minimize the demand for fresh hydrogen. In certain embodiments the integrated systems described herein only require fresh hydrogen to initiate the operation. Once the reaction reaches the equilibrium, the hydrogen purification system can provide enough high purity hydrogen to maintain the operation of the entire system.

The invention claimed is:

1. An integrated hydrotreating and steam pyrolysis process for the direct processing of a crude oil to produce olefinic and aromatic petrochemicals, the process comprising the sequential steps of:

(a1) separating the crude oil into light components and heavy components, wherein the lower boiling point of the boiling point range of said heavy components is 350° C.;

(b1) charging the heavy components and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity;

(c1) charging the hydroprocessed effluent and steam to a convection section of a steam pyrolysis zone;

(d1) heating the mixture from step (c1) and passing it to a vapor-liquid separation section;

(e1) removing from the steam pyrolysis zone a residual portion from the vapor-liquid separation section;

(f1) charging light components from step (a1), a light portion from the vapor-liquid separation section, and steam to a steam pyrolysis zone for thermal cracking;

(g1) recovering a mixed product stream from the steam pyrolysis zone;

(h1) separating the thermally cracked mixed product stream;

(i1) purifying hydrogen recovered in step (h1) and recycling it to step (b1);

(j1) recovering olefins and aromatics from the separated mixed product stream; and (k1) recovering pyrolysis fuel oil from the separated mixed product stream;

wherein step (h1) comprises: compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (j1) and pyrolysis fuel oil as in step (k1) from the remainder of the dehydrated compressed thermally cracked mixed product stream with a reduced content of hydrogen sulfide and carbon dioxide; and wherein step (i1) comprises purifying recovered hydrogen from the dehydrated compressed thermally cracked mixed product stream with a reduced content of hydrogen sulfide and carbon dioxide for recycle to the hydroprocessing zone.

2. The integrated process of claim 1, wherein recovering hydrogen from the dehydrated compressed thermally cracked mixed product stream with a reduced content of hydrogen sulfide and carbon dioxide further comprises separately recovering methane for use as fuel for burners and/or heaters in the thermal cracking step.

3. The integrated process of claim 1 wherein separating the heated hydroprocessed effluent into a vapor fraction and a liquid fraction is with a vapor-liquid separation device based on physical and mechanical separation.

4. An integrated hydroprocessing, steam pyrolysis and resid hydrocracking process for direct conversion of crude oil to produce olefinic and aromatic petrochemicals, the process comprising:

(a2) hydroprocessing the crude oil in the presence of hydrogen under conditions effective to produce a hydroprocessed effluent having a reduced content of contaminants, an increased paraffinicity, reduced Bureau of Mines Correlation Index, and an increased American Petroleum Institute gravity, wherein the hydroprocessing zone consists of a hydroprocessing zone more than one bed containing an effective amount of hydrodemetallization catalyst, and more than one bed containing an effective amount of hydroprocessing catalyst having hydrodearomatization, hydrodenitrogenation, hydrodesulfurization and hydrocracking functions;

(b2) thermally cracking said hydroprocessed effluent in the presence of steam in a steam pyrolysis zone under conditions effective to produce a mixed product stream;

(c2) processing heavy components derived from the mixed product stream, in a resid hydrocracking zone to produce resid intermediate product, wherein said resid hydrocracking zone is an ebullated bed reactor, wherein the ebullated bed reactor comprises a catalyst comprising at least one element selected from the group consisting of Co, Mo and Ni on an alumina support and process conditions comprise a temperature of 350° C. and a pressure of 5-25 MPa gauge;

(d2) conveying the resid intermediate product to the step of thermally cracking; and (e2) recovering olefins and aromatics from the mixed product stream; wherein the catalyst is continuously replaced;

(f2) recovering pyrolysis fuel oil from the combined mixed product stream as at least a portion of the heavy components cracked in step (c);

(g2) separating the hydroprocessed effluent from step (a) into a vapor phase and a liquid phase in a vapor-liquid separation zone, wherein the vapor phase is thermally cracked in step (b), and at least a portion of the liquid phase is processed in step (c); and (h2) heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c2).

5. The integrated process of claim 4, wherein separating the heated hydroprocessed effluent into a vapor phase and a liquid phase is with a vapor-liquid separation device based on physical and mechanical separation.

6. The integrated process of claim 4, further comprising the step of subjecting the compressed thermally cracked mixed product stream to caustic treatment to produce a thermally cracked mixed product stream with a reduced content of hydrogen sulfide and carbon dioxide.

7. The integrated process according to claim 4, further comprising the step of recovering hydrogen from the dehydrated compressed thermally cracked mixed product stream with a reduced content of hydrogen sulfide and carbon dioxide.

8. The integrated process according to claim 4, further including the steps of separating the hydroprocessed effluents in a high pressure separator to recover a gas portion that is cleaned and recycled to the hydroprocessing zone as an additional source of hydrogen, and a liquid portion, and separating the liquid portion derived from the high pressure separator into a gas portion and a liquid portion in a low pressure separator, wherein the liquid portion derived from the low pressure separator is the feed to the thermal cracking step and the gas portion derived from the low pressure separator is combined with the combined product stream after the steam pyrolysis zone and before separation in step (e2).

9. An integrated hydroprocessing, steam pyrolysis and slurry hydroprocessing process for direct conversion of crude oil to produce olefinic and aromatic petrochemicals, the process consisting of the steps of:

(a3) hydroprocessing the crude oil and a slurry process product in the presence of hydrogen under conditions effective to produce a hydroprocessed effluent having a reduced content of contaminants, an increased paraffinicity, reduced Bureau of Mines Correlation Index, and an increased American Petroleum Institute gravity, wherein the hydroprocessing zone includes plural reaction vessels each containing catalyst beds of different function, wherein the different function is selected from the group consisting of hydrodearomatization, hydrodenitrogenation, hydrodesulfurization and/or hydrocracking functions;

(b3) thermally cracking said hydroprocessed effluent in the presence of steam in a steam pyrolysis zone under conditions effective to produce a mixed product stream;

(c3) processing heavy components derived from one or more of the hydroprocessed effluent, a heated stream within the steam pyrolysis zone, or the mixed product stream, in a slurry hydroprocessing zone to produce slurry intermediate product;

(d3) conveying the slurry intermediate product to the step of thermally cracking;

(e3) separating a combined product stream including thermally cracked product and slurry intermediate product;

(f3) purifying hydrogen recovered in step (e3) and recycling it to the step of hydroprocessing;

(g3) recovering olefins and aromatics from the separated combined product stream; and (h3) separating the hydroprocessed effluent from step (a3) into a vapor phase and a liquid phase in a vapor-liquid separation zone, wherein the vapor phase is thermally cracked in step (b3), and at least a portion of the liquid phase is processed in step (a3).

10. The integrated process of claim 9, further comprising recovering pyrolysis fuel oil from the combined mixed product stream for use as at least a portion of the heavy components cracked in step (c3).

11. The integrated process according to claim 9, further comprising separating the hydroprocessed effluent from step (a) into a vapor phase and a liquid phase in a vapor-liquid separation zone, wherein the vapor phase is thermally cracked in step (b3), and at least a portion of the liquid phase is processed in step (c3).

12. The integrated process according to claim 9, wherein step (b3) further comprises heating said hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (a3).

13. The integrated process according to any claim 9, wherein step (b3) further comprises heating hydroprocessed effluent in a convection section of the steam pyrolysis zone, separating the heated hydroprocessed effluent into a vapor phase and a liquid phase, passing the vapor phase to a pyrolysis section of the steam pyrolysis zone, and discharging the liquid phase for use as at least a portion of the heavy components processed in step (c3).

14. An integrated hydrotreating and steam pyrolysis process for the direct processing of crude oil to produce olefinic and aromatic petrochemicals, the process consisting of the steps of:

(a4) charging the crude oil and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity;

(b4) thermally cracking hydroprocessed effluent in the presence of steam in a steam pyrolysis zone to produce a mixed product stream;

(c4) separating the thermally cracked mixed product stream into hydrogen, olefins, aromatics and pyrolysis fuel oil;

(d4) purifying hydrogen recovered in step (c4) and recycling it to step (a4);

(e4) recovering olefins and aromatics from the separated mixed product stream;

(f4) recovering pyrolysis fuel oil from the separated mixed product stream; and (g4) separating the hydroprocessed effluent from the hydroprocessing zone into a heavy fraction and a light fraction in a hydroprocessed effluent separation zone, wherein the light fraction is the hydroprocessed effluent that is thermally cracked in step (b4), and wherein at least a part of the heavy fraction is used as a quenching medium to the inlet of a quenching zone;

wherein at least a part of the heavy fraction is blended with pyrolysis fuel oil recovered in step (f4);

wherein step (c4) comprises:

compressing the thermally cracked mixed product stream with plural compression stages, subjecting the compressed thermally cracked mixed product stream to caustic treatment to produce a thermally cracked mixed product stream with a reduced content of hydrogen sulfide and carbon dioxide, compressing the thermally cracked mixed product stream with a reduced content of hydrogen sulfide and carbon dioxide, dehydrating the compressed thermally cracked mixed product stream with a reduced content of hydrogen sulfide and carbon dioxide, recovering hydrogen from the dehydrated compressed thermally cracked mixed product stream with a reduced content of hydrogen sulfide and carbon dioxide; and obtaining olefins and aromatics as in step (e4) and pyrolysis fuel oil as in step (f4) from the remainder of the dehydrated compressed thermally cracked mixed product stream with a reduced content of hydrogen sulfide and carbon dioxide, step (d4) comprises purifying recovered hydrogen from the dehydrated compressed thermally cracked mixed product stream with a reduced content of hydrogen sulfide and carbon dioxide for recycle to the hydroprocessing zone;

wherein recovering hydrogen from the dehydrated compressed thermally cracked mixed product stream with a reduced content of hydrogen sulfide and carbon dioxide further comprises separately recovering methane for use as fuel for burners and/or heaters in the thermal cracking step; and wherein the thermal cracking step comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction.

* * * * *